US008002378B2

(12) United States Patent
Endo

(10) Patent No.: US 8,002,378 B2
(45) Date of Patent: Aug. 23, 2011

(54) NOZZLE TESTING APPARATUS, NOZZLE TESTING METHOD, AND TEST PROGRAM

(75) Inventor: Hironori Endo, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 593 days.

(21) Appl. No.: 11/781,743

(22) Filed: Jul. 23, 2007

(65) Prior Publication Data

US 2008/0018692 A1 Jan. 24, 2008

(30) Foreign Application Priority Data

Jul. 24, 2006 (JP) ..... 2006-200398

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,484,199 A * 11/1984 Watanabe ..... 347/19
6,969,159 B2 * 11/2005 Su et al. ..... 347/80

FOREIGN PATENT DOCUMENTS

JP 59-123673 7/1984
JP 59-178256 10/1984
JP 11-170569 6/1999
JP 2004-195760 7/2004

* cited by examiner

*Primary Examiner* — Julian D Huffman
(74) *Attorney, Agent, or Firm* — Workman Nydegger

(57) ABSTRACT

A nozzle testing apparatus and method that tests whether recording liquid is ejected from a plurality of nozzles provided in a print head using changes of voltages between measurement terminals that are generated in accordance with ejection of the charged recording liquid. The apparatus comprises a voltage applying unit capable of charging the recording liquid to a predetermined electric potential level by applying a voltage between measurement terminals in a predetermined direction, a head driving unit capable of ejecting the charged recording liquid from the nozzles, a voltage change acquiring unit that acquires the change in voltage between the measurement terminals generated in response to the ejection of the recording liquid, and an ejection checking unit that determines whether the recording liquid is ejected from each nozzle in the plurality of nozzles by using the acquired changes in voltage.

13 Claims, 13 Drawing Sheets

NOZZLE TESTING APPARATUS, NOZZLE TESTING METHOD, AND TEST PROGRAM

The entire disclosure of Japanese Patent Application No. 2006-200398, filed Jul. 24, 2006 is expressly incorporated herein by reference.

BACKGROUND

1. Technical Field

The present invention relates liquid ejection apparatuses. More specifically, the present invention relates to an apparatus and method of testing whether the recording liquid is ejected from a plurality of nozzles in a print head.

2. Related Art

Generally, ink jet recording apparatuses print on recording media by ejecting recording liquid from nozzles provided in print heads. When the recording liquid is not ejected from the nozzles the print images fail to print correctly. In order to determine if the recording liquid has successfully been ejected from the nozzles, various technological methods for testing whether recording liquid is ejected properly have been proposed. For example, one technology detects the change in the electric field intensity between electrodes in the apparatus by using charged ink droplets (see Japanese Patent JP-A-59-178256). One difficulty in using the charged ink droplets is that the ink droplets have small volumes, making it difficult to detect the change in the electric field intensity using one ink droplet. In response, another technology acquires the change (voltage change) of detectable electric field intensity by ejecting a plurality of ink droplets from each nozzle (see Japanese Patent JP-A-11-170569).

In recording apparatuses capable of printing high definition images, such as printers used for printing photographs, the print heads have hundreds to thousands of nozzles. Accordingly, when a test for ejection of recording liquid from nozzles is performed for these recording apparatuses by using known the charged ink droplet technology described above, the amount of time required to test the many test nozzles and a plurality of ink droplets is extensive.

In addition, in the technology disclosed in the Japanese JP-A-59-178256 and JP-A-11-170569 patents, the ejection timing of the ink droplets among nozzles includes a standby time between the ejection of ink droplets from one nozzle to the ejection of ink droplets from the next nozzle. Accordingly, when the test is performed for all the nozzles in a high definition apparatus, the time required for the test is lengthened due to the standby time.

In addition, the Japanese JP-A-59-178256 and JP-A-11-170569 applications, fail to provide a detailed description of the detected change in the voltage in relation to the change of detected electric field intensity due to the ejection of ink droplets.

SUMMARY

An advantage of some aspects of the invention is that it provides technology for determining whether ink droplets are ejected using the voltage change between electrodes from charged ink droplets. The invention describes a nozzle testing apparatus, a nozzle testing method, and a test program which are capable of testing a plurality of nozzles in a speedy manner.

A first aspect of the invention is a nozzle testing apparatus capable of testing whether recording liquid is ejected from a plurality of nozzles provided in a print head by using changes in voltage between the measurement terminals that are generated in response to the ejection of the charged recording liquid. The nozzle testing apparatus is comprised of a voltage applying unit capable of charging the recording liquid to a predetermined electric potential level by applying a voltage between the measurement terminals in a predetermined direction, a head driving unit capable of ejecting the charged recording liquid from the nozzles, a voltage change acquiring unit that acquires the changes in the voltage between the measurement terminals that are generated in response to the ejection of the recording liquid, and an ejection checking unit that determines whether the recording liquid was ejected from the plurality of nozzles using the acquired changes in the voltage.

The present invention may also be conceived as a testing method. According to a second aspect of the invention, there is a nozzle testing method in which the nozzles provided in a print head are tested by using changes in the voltage between measurement terminals that are generated in response to the ejection of the charged recording liquid. The nozzle testing method comprises charging the recording liquid to a predetermined electric potential level by applying a voltage between the measurement terminals in a predetermined direction, ejecting the charged recording liquid from the nozzles, acquiring the changes of the voltages between the measurement terminals that are generated in response to the ejection of the recording liquid, and determining whether the recording liquid is ejected from the plurality of nozzles by using the acquired changes in the voltage.

By using the nozzle testing method, the same advantages as the above-described nozzle testing apparatus may be achieved. The nozzle testing method may be performed in a nozzle testing apparatus having the various aspects described above or a different aspect. Furthermore, a sequence for implementing each function of the above-described nozzle testing apparatus may be included.

The present invention may be implemented as a program for allowing a computer to perform the nozzle testing method by executing of the program on a predetermined operation system. Using this configuration, the above-described nozzle testing method may be performed, and the same advantages as the above-described nozzle testing apparatus can be acquired. This program may be recorded on a computer-readable recording medium and may be transferred to a computer through a transmission medium such as the Internet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
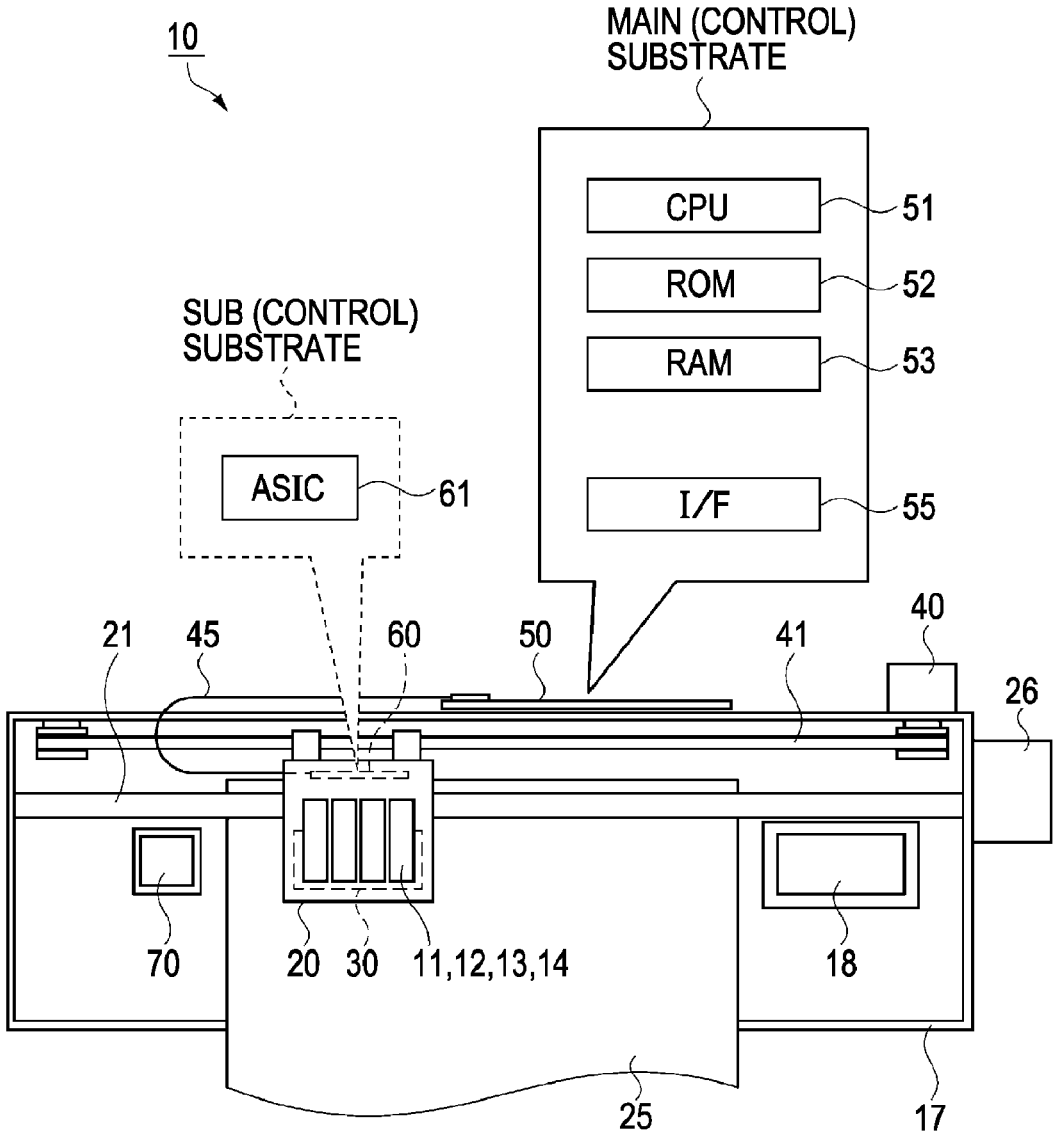
FIG. 1 is a schematic structure of an ink jet printer according to an embodiment of the invention.

Hereinafter, an embodiment of the present invention will be described with reference to FIG. 1. FIG. 1 shows a schematic structure of an ink jet printer 10 in which a nozzle testing apparatus according to an embodiment of the invention is installed. The ink jet printer 10 ejects ink droplets from a print head 30 provided on the lower side of a carriage 20. The carriage 20 includes ink cartridges 11 to 14 for storing ink of Y (yellow), M (magenta), C(cyan), K (black) colors, and moves in a left-to-right or right-to-left direction, while the printing medium 25 moves in an up or down direction, in order to print a predetermined image on the printing medium 25.

The carriage 20 is fixed to a carriage belt 41 and moves along a guide 21 fixed to a frame 17, in association to the movement of the carriage belt 41 driven by a carriage motor 40. The printing medium is moved in an up or down direction in the figure by a paper transport roller (not shown) or the like, which is driven by a driving motor 26 fixed to the frame 17. During this process, predetermined ink droplets corresponding to a print image are ejected from a plurality of nozzles provided in the print head for ejecting ink of various colors. Thus, when the ink droplets are not ejected, an image cannot be printed correctly.

Therefore, testing nozzles to determine whether ink droplets are ejected from the plurality of nozzles provided in the print head is performed at a predetermined timing when power is turned on, before start of a print job, or the like. In the nozzle test, the carriage 20 is moved to a position of a test box 70 provided in the ink jet printer 10 and a predetermined nozzle testing process is performed for testing ejection of ink droplets from the nozzles. When there is a nozzle that does not eject ink droplets, the carriage is moved to the position of a cleaning box 18 provided in the ink jet printer 10 and a predetermined cleaning treatment is performed for cleaning the nozzle.

Control operations of the above-described operations are mainly performed by a control substrate (abbreviated as a main substrate) 50 that is attached to the frame 17 and a subsidiary control substrate (abbreviated as a subsidiary substrate) 60 that is attached to an end face of the carriage 20. The substrates are connected to each other with a flexible substrate 45 and are configured so as to be capable of exchanging data with each other.

The main substrate 50 includes a CPU 51 for controlling various operations of the ink jet printer 10, a ROM 52 for storing a program for the operations, a RAM 53 for temporarily storing or reading out data needed for the operations, and an interface (I/F) 55 for exchanging data with the subsidiary substrate 60 or exchanging information with external devices such as a user's personal computer. A program for testing a nozzle according to embodiments described later is stored in the ROM 52.

The subsidiary substrate 60 includes an ASIC 61 having a logic circuit for performing a predetermined operation for the nozzle test. Thus, the CPU 51 reads a nozzle test program stored in the ROM 52 and sends/receives various signal data to/from the ASIC 61, whereby the CPU 51 and the ASIC 61 perform the nozzle test.

Figure 2:
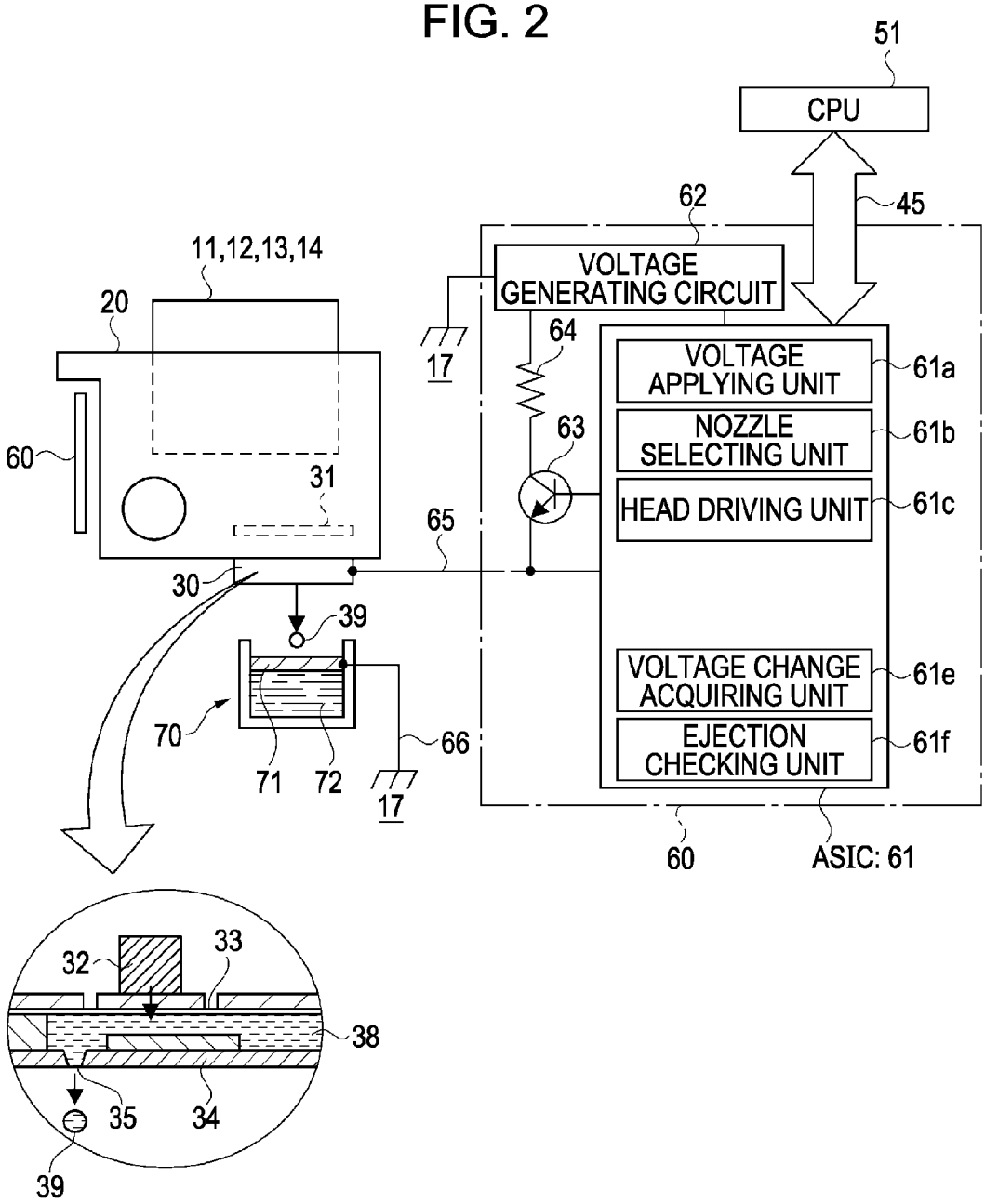
FIG. 2 is a schematic diagram showing a configuration of a nozzle testing apparatus according to an embodiment of the invention.

Next, the structure of the nozzle testing apparatus will be described in more detail with reference to FIG. 2. FIG. 2 is a schematic diagram showing a configuration of the nozzle testing apparatus for determining whether ink is ejected from a plurality of nozzles provided in the print head 30 using charged ink droplets by applying pressure to the ink. When the carriage 20 moves to the test box 70, the ink supplied from the ink cartridge 11 to the print head 30 through a supply passage (not shown) is ejected from the print head 30 as ink droplets.

Within the plurality of nozzles provided in the print head 30, mechanisms for generating pressure for ejecting ink from each nozzle are formed as shown in a circle in lower part of in FIG. 2. In this example, a configuration is used in which a piezoelectric element 32 is deformed to push a member 33 in a direction indicated by an arrow (lower side in the figure) so as to depress the ink 38, which is transferred from the ink cartridge 11 when a voltage is applied to the piezoelectric element 32. As a result, the ink is ejected from a nozzle 35 provided in a nozzle plate 34 as ink droplets 39. Accordingly, it can be tested whether ink droplets are ejected from a nozzle by applying a voltage to a piezoelectric element corresponding to the nozzle to be tested. The voltage used for the deformation of the piezoelectric element 32 is output from a driver substrate 31 as a piezoelectric element driving signal. The driver substrate 31 is provided in the carriage 20 near the print head 30 and is connected to the subsidiary substrate 60 with a wiring member (not shown) so as to operate in accordance with reception of an output signal from the ASIC 61.

The ejected ink droplets 39 are attached to an electrode member 71 provided in the test box 70. The electrode member 71 is made of a metal material such as a mesh-shaped SUS plate and serves as an attachment receiving area of the ink droplets 39. Thereafter, ink droplets 39 permeate the electrode member 71 and are absorbed by an ink absorber 72 made of a sponge-like resin or the like. As described above, the electrode member 71 is configured such that the ink is not collected therein. The electrode member 71 is electrically connected to the frame 17 with the wiring member 66.

The ASIC 61 built to the subsidiary substrate 60 sends/receives data to/from the CPU 51 through the flexible substrate 45, thereby forming a voltage applying unit 61*a*, a nozzle selecting unit 61*b*, a head driving unit 61*c*, a voltage change acquiring unit 61*e*, and an ejection checking unit 61*f* as functional blocks for performing a nozzle test process. These units perform the various processes described below.

After generating a predetermined voltage in respect to the frame 17 by operating a voltage generating circuit 62 with one terminal grounded to frame 17, the voltage applying unit 61*a* turns on a switching transistor 63 during a nozzle test process in order to apply a voltage from the wiring member 65 to the print head 30 through a resistor 64 having a predetermined resistance value. The portion of the print head 30 where the voltage is applied is an area (such as the nozzle plate 34) that is electrically conductive with the ink 38.

In the embodiment, the voltage applied to the print head 30 is configured to have a positive value with respect to the frame 17. Thus, as described above, a voltage is generated between the print head 30 and the electrode member 71 inside the test box that is electrically connected to the frame 17 in a direction from the print head 30 side to the electrode member 71. As a result, the print head 30 is charged positively and the electrode member 71 is charged negatively.

The nozzle selecting unit 61*b* generates a selection signal that is used for selecting a test nozzle. The head driving unit 61*c* generates a driving signal for a piezoelectric element so as to eject ink droplets from the selected nozzle. Thereafter, these signals are sent to the driver substrate 31 and are outputted from the driver substrate 31 to a piezoelectric element corresponding to the test nozzle, driving the piezoelectric element. This operation will now be described with reference to FIG. 3.

Figure 3:
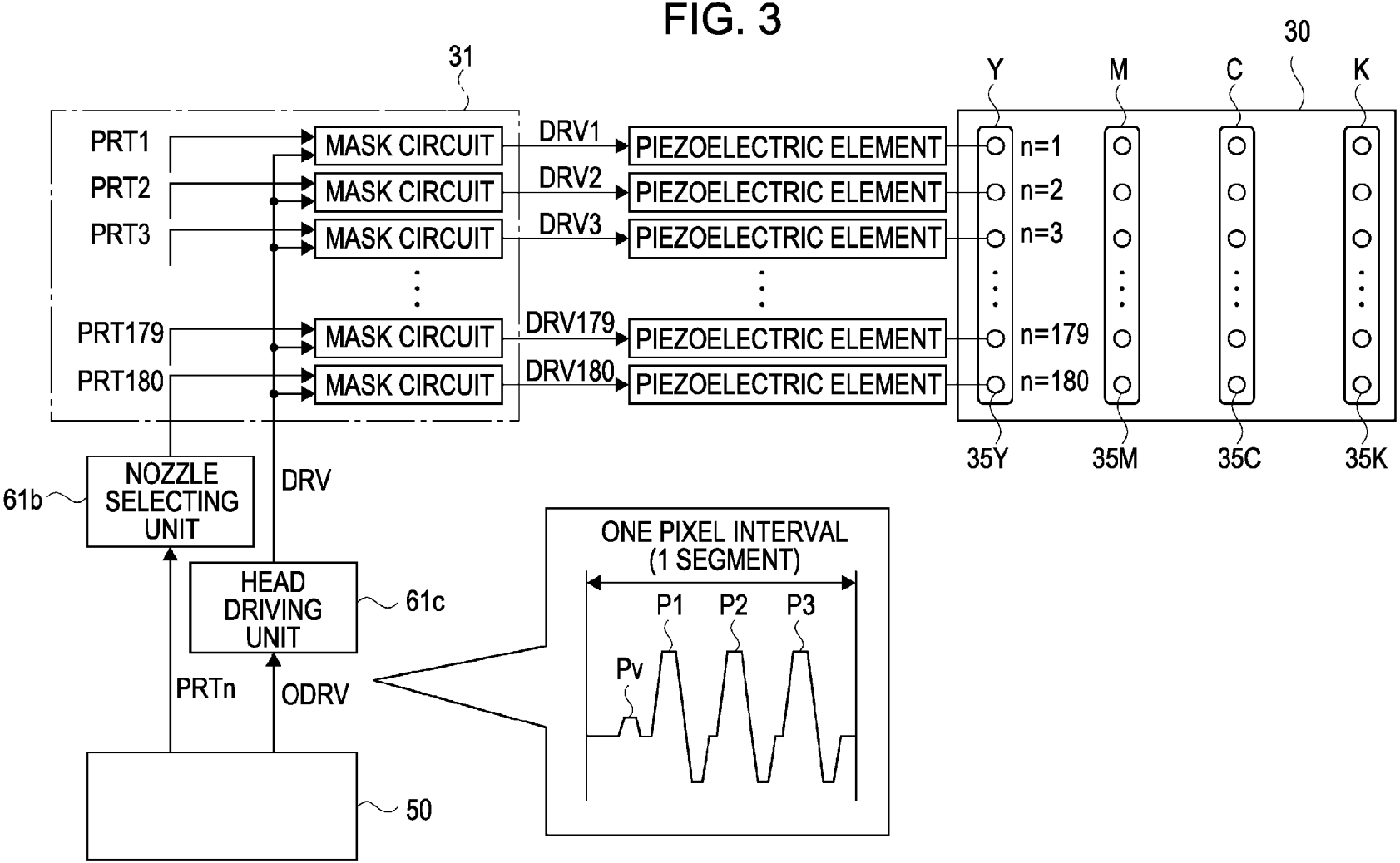
FIG. 3 is a schematic diagram showing a method of driving a piezoelectric element for ejecting ink droplets from a test nozzle according to an embodiment of the invention.

FIG. 3 is a schematic diagram showing a method of driving a piezoelectric element for ejecting ink droplets from a nozzle to be tested. In the embodiment, nozzle arrays 35Y, 35M, 35C, and 35K corresponding to the colors of Y, M, C, and K are provided in the print head 30 and 180 nozzles of n=1 to 180 are formed in each nozzle array. As described above, in this example, a total of 720 nozzles to are formed in the print head 30 which need testing. In order to eject ink droplets from the nozzles to be tested, driving signals DRVn (n=1 to 180) for deforming/driving the piezoelectric elements 32 (see FIG. 2) corresponding to the selected nozzles are outputted for each nozzle array of the color Y, M, C, or K.

The driving signals DRVn are generated as follows. In the main substrate 50, an original signal ODRV is generated in which a unit signal (an extracted portion in FIG. 2) having total four signals of Pv, P1, P2, and P3 is repeated. A print signal PRTn determines a nozzle for ejecting ink droplets when the printing operation is performed in an interval (the time the carriage 20 takes to traverse a distance of one pixel, also referred to as a segment) for printing one pixel of an image. The print signal PRTn (n=1 to 180) is used for determining which nozzle from which to eject the ink droplets from among 180 nozzles in each nozzle array at the time when the carriage 20 moves left-to-right or right-to-left over the printing medium 25 so as to locate the nozzle arrays 35Y to 35K of the colors Y, M, C, and K to a print position. Accordingly, while the print signal PRTn is used for selectively supplying the driving signal to a nozzle by selecting the nozzle from which ink droplets are to be ejected or print data (dots for printing or grayscale values) on the basis of the print image at a time when a print operation is performed, the print signal PRTn is used for selectively supplying the driving signal to a nozzle from which ink droplets are to be ejected for testing when a test operation is performed. PRTn is generated for each color nozzle, wherein n is an integer from 1 to 180 in accordance with the print data.

The head driving unit 61*c* generates a test driving signal DRV that is used for the nozzle test. The signal DRV uses the original signal ODRV generated in the main substrate 50 and sends the original signal DRV to a mask circuit of the driver substrate. The pulse signal Pv included in the original signal ODRV is used for vibrating the ink so prevent the ink from hardening by slightly vibrating the piezoelectric element. P1, P2, and P3 are pulse signals for ejecting one ink droplet from a nozzle. A small dot is formed on the print medium for P1, a medium dot for P1 and P2, or a large dot is formed for P1, P2, and P3. Accordingly, in the embodiment, the head driving unit 61*c* generates a test driving signal (hereinafter, referred to as a head driving signal) DRV repetitively and continuously. The head driving signal includes a unit signal including a pulse signal including P1, P2, and P3. As described above, by using all the pulse signals P1 to P3 for the nozzle test, there is a high probability that voltage will change between measurement terminals when the plurality of ink droplets are ejected. This will be described later with reference to FIGS. 4A, 4B, 4C, and 4D.

The nozzle selecting unit 61*b* determines a test nozzle using a print signal PRTn. Since a nozzle test is performed in order to detect any nozzles which are not ejecting ink droplets by sequentially selecting nozzles for testing, the nozzle selecting unit 61*b* sends a print signal PRTn orderly selected from n=1 to n=180 to the mask circuit of the driver substrate 31 using the output start timing of the head driving signal DRV as nozzle selecting signals for selecting a test nozzle.

The mask circuit is configured to output the head driving signal DRV to a piezoelectric element corresponding to a test nozzle determined by the print signal PRTn and mask the head driving signal DRV from the other piezoelectric elements. In order words, head driving signal DRV is output sequentially and repeatedly to only a piezoelectric element corresponding to a selected nozzle to be tested by using the mask circuit and the head driving signal DRV. The nozzle selecting unit 61*b* applies this sequence to all the nozzle arrays of the colors of Y, M, C, and K. As a result, piezoelectric elements corresponding to all the nozzles are sequentially driven.

In the embodiment, although the head driving signal DRV including a P1, P2, and P3 pulse signal is inputted into the mask circuit, the original signal ODRV including the pulse signal Pv may be directly input to the mask circuit. In this case, the original signal including a pulse signal including Pv, P1, P2, and P3 in one segment is inputted to the mask circuit. The nozzle to be tested is determined using the print signal PRTn. The pulse signal Pv that is not used for testing is masked, and the pulse signals P1, P2, and P3 that are used for testing are selected so as to be supplied to the nozzle to be tested as a driving signal. In this case, the print signal PRTn is used as a signal for selecting a nozzle to be driven and is used to select a pulse signal in the original signal ODRV to be supplied to the nozzle.

Referring back to FIG. 2, the voltage change acquiring unit 61*e* acquires change of the voltage between the measurement terminals. The ejection checking unit 61*f* determines whether the ink droplets are ejected from the nozzle to be tested on the basis of the detected voltage change and the direction of the application of the voltage.

Figure 4A:
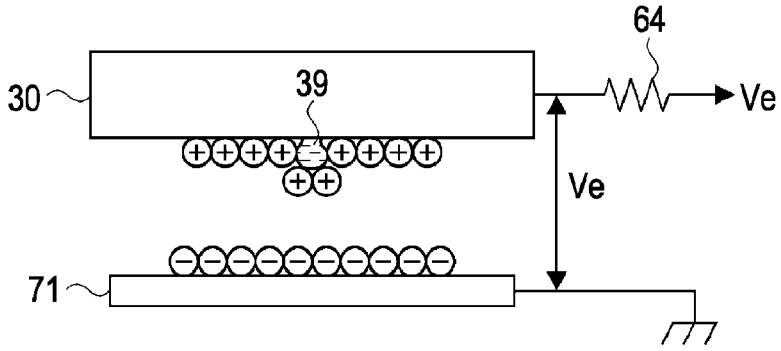
FIGS. 4A, 4B, 4C, and 4D show change in voltage between measurement terminals due to ejection of ink drops according to an embodiment of the invention.
Figure 4B:
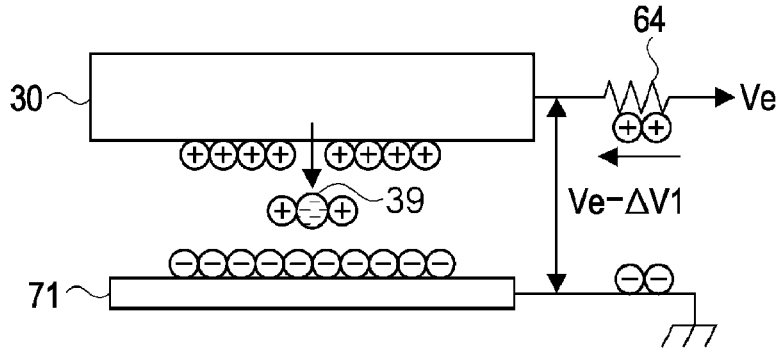
Figure 4C:
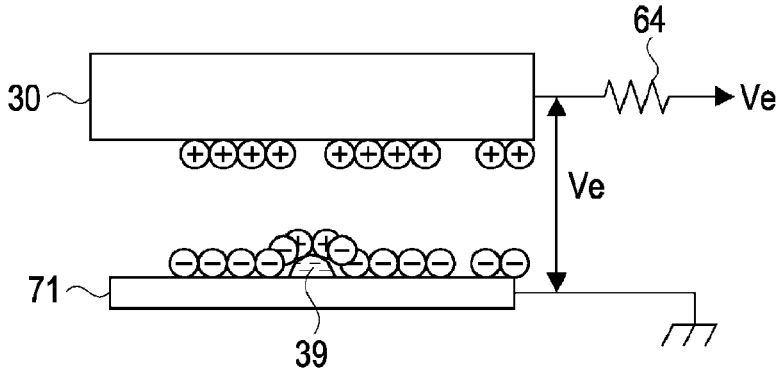
Figure 4D:
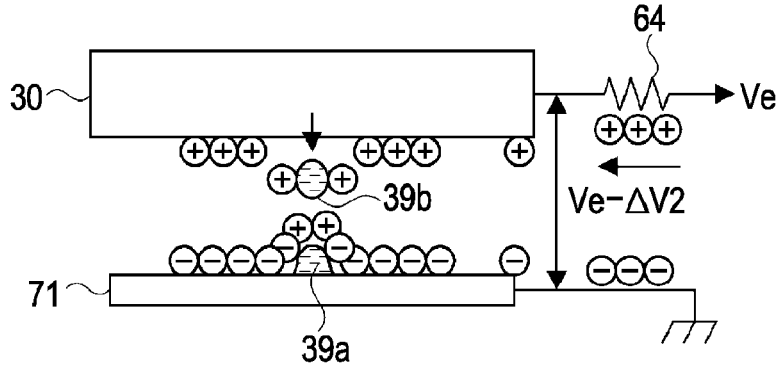
Figure 5:
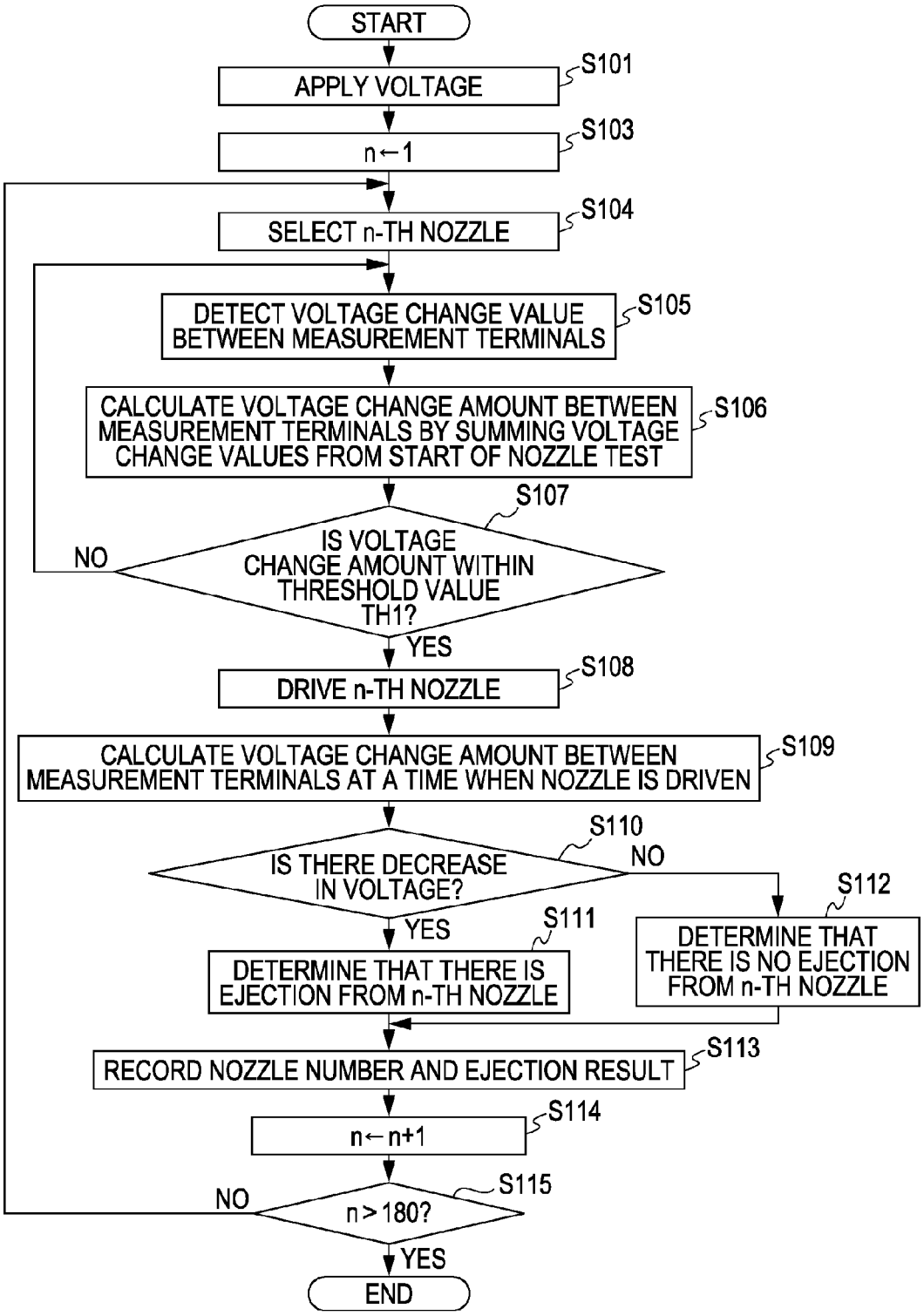
FIG. 5 is a flowchart showing a nozzle testing process according to a first embodiment of the invention.
Figure 7:
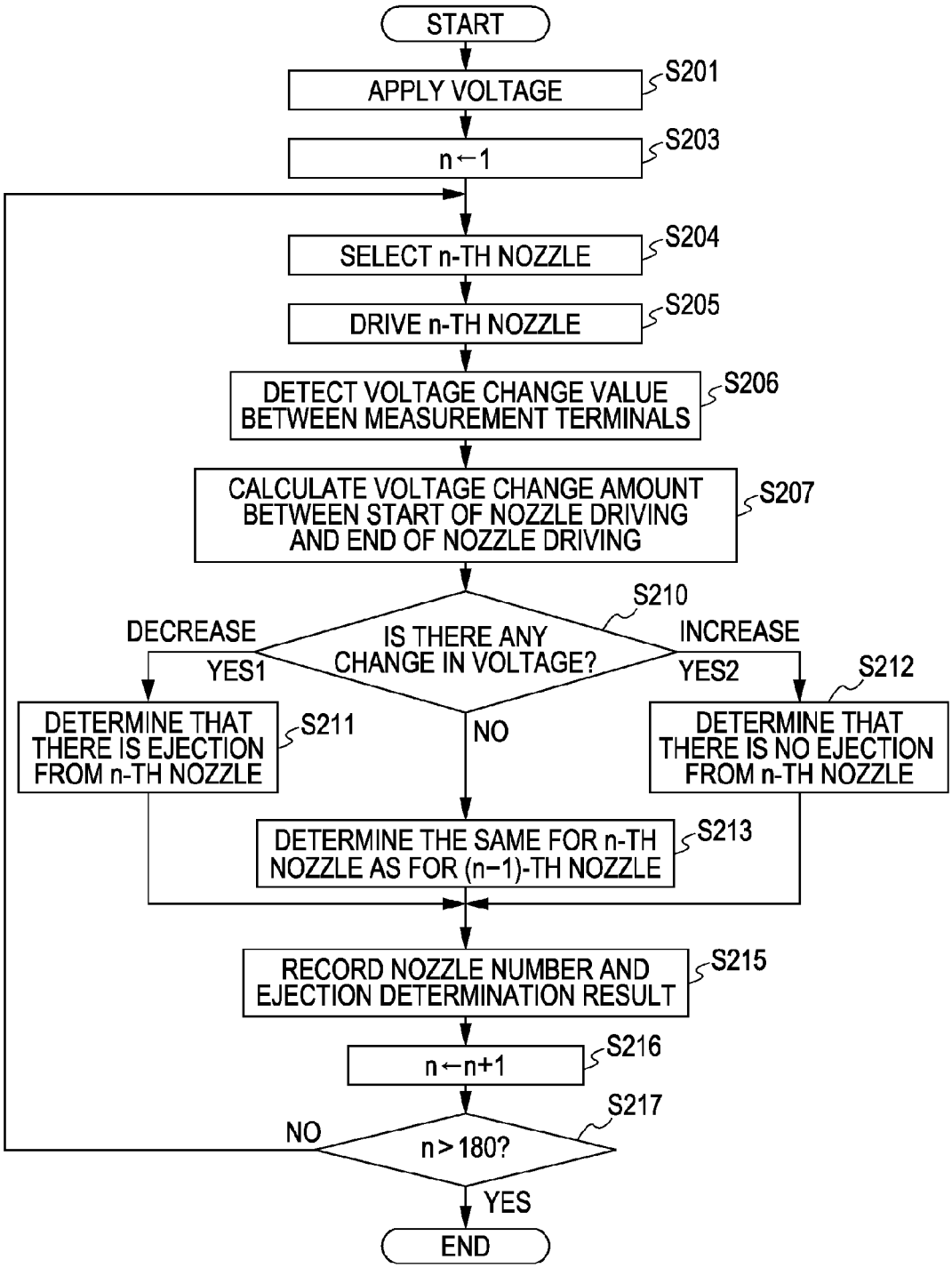
FIG. 7 is a flowchart showing a nozzle testing process according to a second embodiment of the invention.
Figure 9:
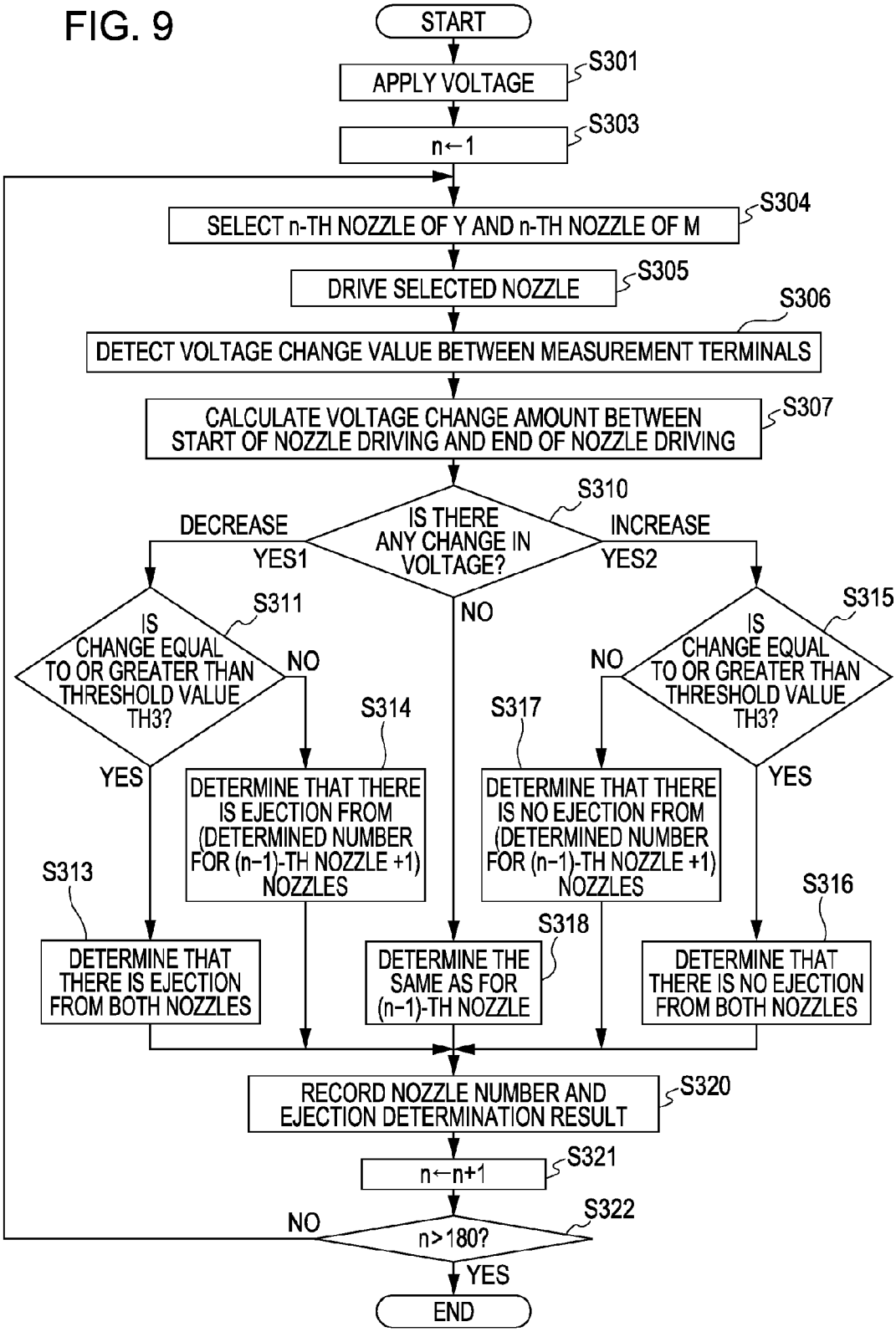
FIG. 9 is a flowchart showing a nozzle testing process according to a third embodiment of the invention.

The above-described functional blocks perform their operations under the control of the CPU 51, thereby performing nozzle test processes of flowcharts shown in FIGS. 5, 7, and 9 so as to test whether the ink droplets are ejected from each nozzle. Before the flowcharts are described, voltage change that is the basis for determination of whether ink droplets are ejected in the embodiment will now be described with reference to FIGS. 4A, 4B, 4C, and 4D.

FIGS. 4A, 4B, 4C, and 4D are diagrams showing voltage change between the print head 30 and the electrode member 71 which occurs at the time when the ink droplets are ejected from a nozzle. FIG. 4A shows the state in which a predetermined voltage Ve is applied between the print head 30 and the electrode member 71 in a direction from the print head 30 to the electrode member 71 through a resistor 64. Accordingly, the print head 30 is charged positively, and the electrode member 71 is charged negatively (grounded). In the status shown in FIG. 4A, since no current flows through the resistor 64, the voltage Ve appears between the print head 30 and the electrode member 71. For convenience of description, it is assumed that ten positive charges are generated on the print head 30 side, and ten negative charges are generated on the electrode member 71. As shown in FIG. 4A, when a piezoelectric element corresponding to a nozzle of the print head 30 to be tested starts to be driven, an ink droplet 39 tends to be ejected together with two positive charges.

As shown in FIG. 4B, when the piezoelectric element is driven for one segment in accordance with a unit signal (see FIG. 3), the ink droplet 39 is ejected from the nozzle, whereby the ink head 30 loses two positive charges. Then, in order to replace the two lost positive charges, two positive charges are supplied through the resistor 64. Thus, a current corresponding to two positive charges flows through the resistor 64, and a voltage drop ΔV1 resulting occurs. As a result, the voltage between the print head 30 and the electrode member 71 decreases to a value calculated by "Ve−ΔV1". At this moment, two negative charges are induced on the electrode member 71 side.

Then, as shown in FIG. 4C, when the ink droplet 39 lands on the electrode member 71, the two positive charges are neutralized with two negative charges on the electrode member 71, and accordingly there are eight negative charges on the electrode member 71. However, then, two induced negative charges are supplied to the electrode member 71, and accordingly, there are ten negative charges on the electrode member 71, which is the same as the original status of the electrode member 71. As a result, since both the print head 30 side and the electrode member 71 side have ten charges, which is the same as the original status thereof, the voltage between the print head 30 and the electrode member 71 increases to its original voltage Ve.

When the unit signals for each segment are consecutively output, the ink droplets 39 are ejected consecutively from the nozzle, whereby sets of two positive charges are sequentially lost from the print head 30. At this moment, as shown in FIG. 4D, when an ink droplet 39*b* is ejected before positive charges ejected together with a firstly ejected ink droplet 39*a* are neutralized, a total of three positive charges including one positive charge for replacement of the positive charge lost due to the ejection of the ink droplet 39*a* and two positive charges for replacement of the two positive charges lost due to the ejection of the ink droplet 19*b* flow through the resistor 64. As a result, a voltage drop ΔV2 much larger than the voltage drop ΔV1 occurs, whereby the voltage between the print head 30 and the electrode member 71 decreases further to a value calculated by "Ve−ΔV2".

As described above, when the ink droplets 39 are ejected consecutively from the print head 30, a large current corresponding to the number of positive charges in accordance with the number of the ejected ink droplets flows through the resistor 64, whereby a large voltage drop occurs. Then, when the number of positive charges supplied through the resistor 64 increases, the supply amount of induced negative charges increases, whereby the number of neutralized positive charges increases. Accordingly, the number of positive charges supplied for replacement of positive charges lost due to the consecutive ejection of the ink droplets becomes the same as the number of neutralized negative charges. Consequently, the voltage stops decreasing and maintains a constant value. As described above, when the ink droplets are consecutively ejected, the change of the voltage continues to decrease and then becomes a constant value, whereby a status in which the voltage does not change may be maintained. When the ejection of the ink is stopped, both the print head 30 side and the electrode member 71 side return to their original status in which ten charges exist. Accordingly, the voltage between the print head 30 and the electrode member 71 increases, returning to its original voltage Ve.

In the embodiment, by using the change of voltage between the print head 30 and the electrode member 71 described above, when the voltage decreases it is determined that there is ejection of ink droplets, since the application direction of the voltage which is from the print head side 30 to the electrode member 71 side. On the other hand, when the voltage decreases, it is determined that there is no ejection of ink droplets.

Hereinafter, a nozzle testing process performed by a nozzle testing apparatus according to an embodiment of the invention will be described with reference to three embodiments of the invention. A first embodiment of the invention is a case where there is an idle period wherein a driving signal for a piezoelectric element is not outputted between test operations for selected test nozzles. A second embodiment of the invention is a case where ink droplets are continuously ejected for the test without the idle period. A third embodiment is a case where a plurality of nozzles to be tested are simultaneously selected and tested.

First Embodiment

Hereinafter, the first embodiment will be described in accordance with a flowchart shown in FIG. 5. At the start of this process, a voltage is applied between the print head 30 and the electrode member 71 (step S101). In the embodiment, the ASIC 61 applies the voltage in the direction from the print head 30 side to the electrode member 71 side by driving a voltage generating circuit. As a result, the print head 30 side is charged positively, and the voltage between the measurement terminals decreases when charged ink droplets are ejected, as described with reference to FIGS. 4A, 4B, 4C, and 4D. In this process, the CPU 51 stores the application direction of the voltage in a predetermined storage area of the RAM 53.

Next, n, which is a test nozzle number, is set to one (step S103), whereby the 1st nozzle is selected (step S104). In other words, at first, nozzle n=1 is selected. In this example, nozzles are selected in the order of nozzle arrays of Y, M, C, and K, and, at first, nozzle n=1 of the nozzle array 35Y of Y is selected. Thereafter, the test process shown in the flowchart of FIG. 5 is performed sequentially for the other nozzle arrays of M, C, and K.

Next, the change in value of the voltage between the measurements terminals is detected (step S105) and the amount of change in the voltage is calculated by summing the change values of the voltage that have been detected after the start of the nozzle test (step S106). Thus, a process for acquiring a voltage change is performed by a voltage change acquiring unit. Then, it is determined whether the change amount of the voltage is within a threshold value TH1 (step S107). When the change amount of the voltage is not within the threshold value TH1 (step S107: No), the process proceeds to step S105 for repeating the process of the steps S106 to S107.

In this embodiment, at step S105, the change value of the voltage between the measurement terminals for each segment is detected by detecting the change value of the voltage between the measurement terminals at an interval of one segment from the time when the nozzle test is started. The change value of the voltage at the print head 30 is input to the ASIC 61, and the change values of the voltage are detected at an interval of one segment, whereby the change values of the voltage between the measurement terminals for each segment are detected. In particular, a capacitance coupling element such as a capacitor (not shown in FIG. 2) is interposed between the print head 30 and the ASIC 61 right after or before input to the ASIC 61. Accordingly, a DC component is filtered out, and the remaining voltage is input to the ASIC 61. When the voltage value to be measured is higher than the operating voltage of the ASIC 61 (for example, several tens to several hundreds of volts), the allowable voltage of the ASIC 61 is required to be high. However, by allowing only the change value of the voltage to be inputted into the ASIC 61, the allowable voltage of the ASIC 61 need not be high. Moreover, the voltage value of the print head 30 may be detected, and the change value of the voltage may be acquired by calculating the change in the voltage between the measurement terminals from the detected voltage value.

The CPU 51 stores the detected voltage change value for each segment in a predetermined storage area of the RAM 53. A positive value is stored for a case where the voltage increase and a negative value is stored for a case where the voltage decreases. In step S106, the CPU 51, after start of the nozzle test, reads out the change values of the voltage for each segment stored in the predetermined area of the RAM 53 for calculating the sum thereof. Accordingly, the summed value represents the change amount (increased or decreased amount) with respect to the voltage between the measurement terminals at the time when the nozzle test is started. The CPU 51 repeats the process of the steps S105 and S106 at an interval of one segment from the start of the nozzle test to the end of the nozzle test.

When the change amount of the voltage between the measurement terminals is within the threshold value TH1 (step S107: YES), the nth nozzle is driven (step S108). As described above, the nozzle is driven after the change amount of the voltage comes within the threshold value TH1 so as to control the voltage value between the measurement terminals at a time when the test is started such that the voltage drop between the measurement terminals due to the ejection of ink droplets is equal to or greater than a threshold value TH2 described later.

At step S108, the nozzle selecting signal PRTn and the head driving signal DRV are outputted to a mask circuit of the driver substrate 31 from the ASIC 61. Then, the driving signal DRVn is outputted from the mask circuit to the piezoelectric element and the piezoelectric element corresponding to the test nozzle is driven, causing the nozzle driving process to be performed.

Then, the amount of the change in the voltage in the measurement terminals in accordance with the output of the head driving signal DRV is calculated (step S109), and it is determined whether there is decrease in the voltage (step S110). When it is determined that the voltage has decreased (YES), the control proceeds to step S111, and it is determined that there has been ejection from the 1st nozzle. On the other hand, when it is determined that the voltage has not decreased (NO), the control proceeds to step S112, it is determined that there is no ejection from the 1st nozzle, and then, the control proceeds to step S113. In the embodiment, the CPU 51 calculates the change amount of the voltage, that is, increased or decreased amount of the voltage by reading out the change values of the voltage for each segment among eight segments between the start of head driving and the end of head driving from the RAM 53. When the calculated decreased amount of the voltage between the measurement terminals exceeds the threshold value TH2, it is determined that the voltage has been decreased. On the other hand, when the calculated decreased amount of the voltage is equal to or smaller than the threshold value TH2, it is determined that the voltage has not decreased. The measured voltage between the measurement terminals in step S110 may vary in a considerable range due to an electric field noise, a pulse signal Pv, or the like from outside of the printer. Accordingly, the threshold value is provided so as to detect the voltage change with a high precision.

Next, the nozzle number and the ejection result are stored (step S113), n is newly set to "n+1" (step S114), and the control proceeds to step S115. In step S115, it is determined whether n is greater than "180. When n is equal to or less than "180", there is a remaining nozzle to be tested, and accordingly, the control proceeds back to step S104 for repeating the above-described process. When the test for all the nozzles is completed (step S115: YES), the process ends. Thereafter, a cleaning process is performed by using the stored nozzle number and the ejection result.

Figure 6A:
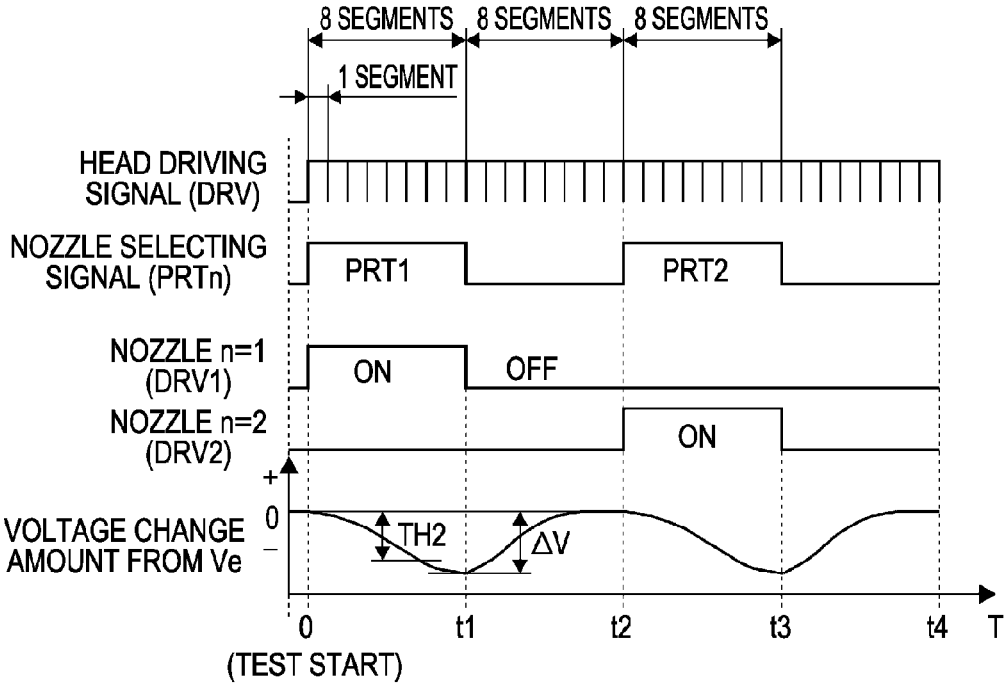
FIG. 6A is a timing chart of signals before the first embodiment of the invention is applied.

Hereinafter, the process will be described in more detail with reference to timing charts shown in FIGS. 6A and 6B. FIG. 6A shows an example before the first embodiment is applied. In the example, a head driving signal DRV in which a unit signal of one segment is repeatedly output and a nozzle selecting signal PRT1 that shifts at an output timing of the head driving signal for each segment are output from the ASIC 61. In addition, driving signals in which the unit signal is output (ON) during 8 segments driving signals in which the unit signal is not output (OFF) during 8 segments thereafter are output to nozzle n=1 and nozzle n=2, respectively. In the embodiment, it is assumed that the unit signal is output during 8 segments as described above. The horizontal axis denotes a time axis T.

At first, a unit signal is output during 8 segments from the start of the test (T=0) to time t1 to nozzle n=1 in accordance with the nozzle selecting signal PRT1. When ink droplets are ejected, as described above with reference to FIGS. 4A, 4B, 4C, and 4D, the voltage Ve between the measurement terminals, as shown in FIG. 6A, gradually decreases in accordance with the number of times that the ink is ejected by ΔV, exceeding the threshold value TH2. Thereafter, since nozzle n=1 is not driven during the 8 segments until time t2, the ink droplets are not ejected again from nozzle n=1, whereby the voltage between the measurement terminals gradually increases so as to be restored to the voltage value Ve. Here, the threshold value TH2, as described above, is used for determining whether ink droplets are ejected from a nozzle.

Next, a pulse signal is output to nozzle n=2 during 8 segments from time t2 to time t3 in accordance with a nozzle selecting signal PRT2. When ink droplets are ejected from nozzle n=2, the voltage Ve between the measurement terminals gradually decreases again in accordance with the number of times of ejection and decreases by ΔV, similar to nozzle n=1. Thereafter, since nozzle n=2 is not driven during the 8 segments from time t3 to time t4, the ink droplets are not ejected again from nozzle n=2, whereby the voltage between the measurement terminals gradually increases so as to be restored to the voltage value Ve.

Figure 6B:
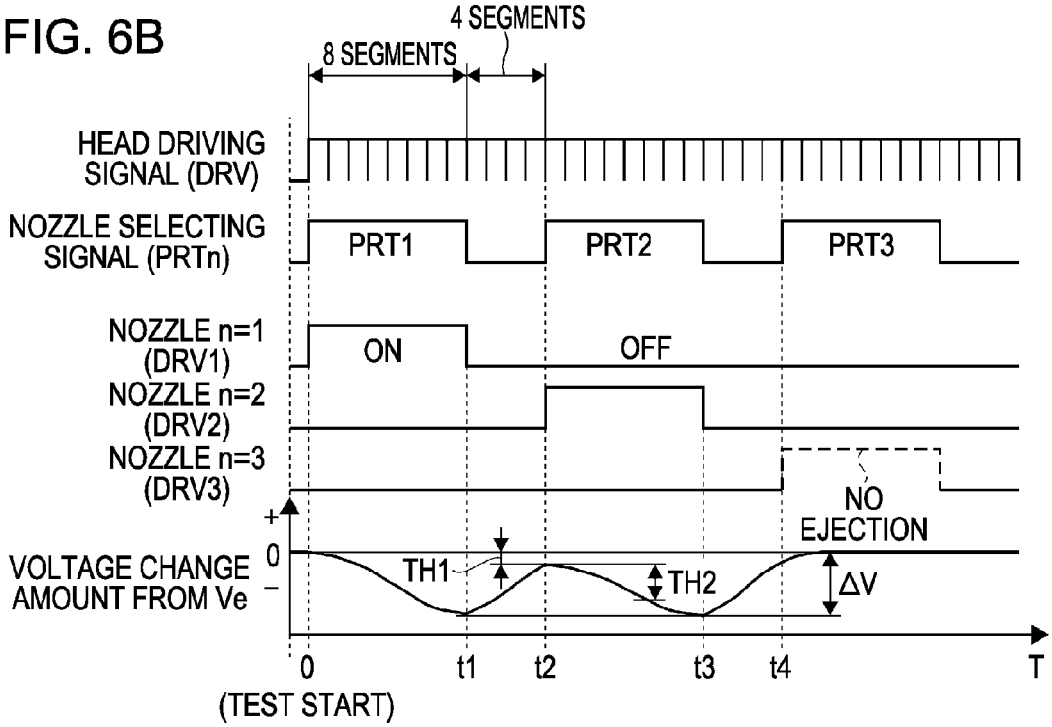
FIG. 6B is a timing chart of signals after the first embodiment of the invention is applied.

In the first embodiment, nozzle n=2 is driven for testing when the difference between the restored voltage value and the voltage Ve is within the threshold value TH1, described more fully with reference to FIG. 6B.

FIG. 6B shows an example in which the voltage between the measurement terminals decreases by ΔV at time t1 in accordance with ON output of the head driving signal DRV1, which is used for driving nozzle n=1, during 8 segments. The voltage is restored to within the threshold value TH1 at time t2 after the OFF output of the head driving signal DRV1 during the following 4 segments. In this case, when ink droplet ejection is tested for the next test nozzle n=2 by outputting a unit signal during 8 segments from time t2 to time t3, a voltage drop equal to or larger than the threshold value TH2 occurs due to ejection of the ink droplets, and accordingly, it is possible to determine whether the ink droplets are ejected. Consequently, in this example, the time interval from t1 to t2 can be shortened by 4 segments, compared to the example shown in FIG. 6A. When the above-described process is performed for all the nozzles (720 nozzles in the embodiment), the time required for the nozzle test can be shortened by a time corresponding to 720×4 segments.

In FIG. 6B, when ink droplets are not ejected from nozzle n=3, as shown in the figure, the voltage between the measurement terminals is returned to the value Ve and does not change thereafter. Accordingly, it is determined that there is no ejection from nozzle n=3.

As described above, according to the first embodiment, the time for shifting the test nozzles can minimized by using decrease in the voltage between the measurement terminals. Accordingly, it becomes possible to determine whether ink droplets are ejected from a nozzle using voltage change and to shorten the time required for test.

Second Embodiment

Hereinafter, the second embodiment will be described in accordance with a flowchart shown in FIG. 7. When this process is started, a voltage is applied between the print head 30 and the electrode member 71 (step S201). Similarly to the first the embodiment, the ASIC 61 applies the voltage having the direction from the print head 30 side to the electrode member 71 side by driving a voltage generating circuit. Accordingly, the print head 30 side is charged positively, and the voltage between the measurement terminals decreases when charged ink droplets are ejected, as described with reference to FIGS. 4A, 4B, 4C, and 4D. On the other hand, when the charged ink droplets are not ejected, the voltage between the measurement terminals increases. In this process, the CPU 51 stores the application direction of the voltage in a predetermined storage area of the RAM 53.

Next, n, which is a test nozzle number, is set to one (step S203), whereby the nth nozzle is selected (step S204). In other words, at first, nozzle n=1 is selected. In the embodiment, nozzles are selected in the order of nozzle arrays of Y, M, C, and K, and, at first, nozzle n=1 of the nozzle array 35Y of Y is selected. Thereafter, the test process shown in the flowchart of FIG. 7 is performed sequentially for the other nozzle arrays of M, C, and K.

Next, the nth nozzle is driven (step S205). In particular, as described with reference to FIG. 3, the nozzle selecting signal PRTn and the head driving signal DRV are outputted to the mask circuit of the driver substrate 31 from the ASIC 61. Then, the driving signal DRVn is outputted from the mask circuit to the piezoelectric element and the piezoelectric element corresponding to the test nozzle is driven, causing the nozzle driving process to be performed.

Next, the change in the voltage between the measurement terminals is detected (step S206) and the change in the voltage between the start of driving the nth nozzle and the end of driving the nth nozzle is calculated by summing the change values of the voltage that have been detected (step S207). This process comprises the voltage change acquiring process. In step S206, change in the voltage between the measurement terminals is detected, similar to the first embodiment. In particular, the change value of the voltage between the measurement terminals for each segment is detected by detecting the change in value of the voltage between the measurement terminals at one segment intervals from the time when the driving of the nth nozzle is started. The CPU 51 stores the detected voltage change value for each segment in a predetermined storage area of the RAM 53. Then, in step S207, the CPU 51 retrieves the change values of the voltage stored in the predetermined area of the RAM 53 for calculating the sum thereof. Accordingly, the summed value represents the change amount (increased or decreased amount) in the voltage between the measurement terminals before and after driving of the nth nozzle.

Next, it is determined whether the voltage has changed (step S210). If it is determined that the voltage has decreased (YES1), the control proceeds to step S211, and it is determined that ink droplets were ejected from the nth nozzle. To the contrary, when it is determined that the voltage has increased (YES2), the control proceeds to step S212, and it is determined that ink droplets were not ejected from the nth nozzle. On the other hand, when it is determined that the voltage has not been changed (NO), the control proceeds to step S213, and the same determination as for the (n−1)th nozzle as was made for the nth nozzle. In the above-described process, the determination is made with reference to the application direction of the voltage.

When the $1^{st}$ nozzle is tested, in step S213, the previous nozzle, that is, a nozzle prior to the 1st nozzle does not exist, and thus, a default determination that ink droplets were not ejected from the (n−1)th nozzle is used.

In the embodiment, as in the first embodiment, in order to reduce incorrect determinations due to the above-described noise or the like, it is determined that there is increase or decrease in the voltage for determination of the increase or decrease of the voltage between the measurement terminals when the increased or decrease amount that is the change amount of the voltage exceeds the threshold value TH2.

Next, the nozzle number and the ejection result are stored (step S215), n is newly set to "n+1" (step S216), and the control proceeds to step S217. In step S217, it is determined whether n is greater than "180. When n is equal to or less than "180", there is a remaining nozzle to be tested, and accordingly, the control proceeds back to step S204 for repeating the above-described process. When the test for all the nozzles is completed (step S217: YES), the process ends.

Figure 8A:
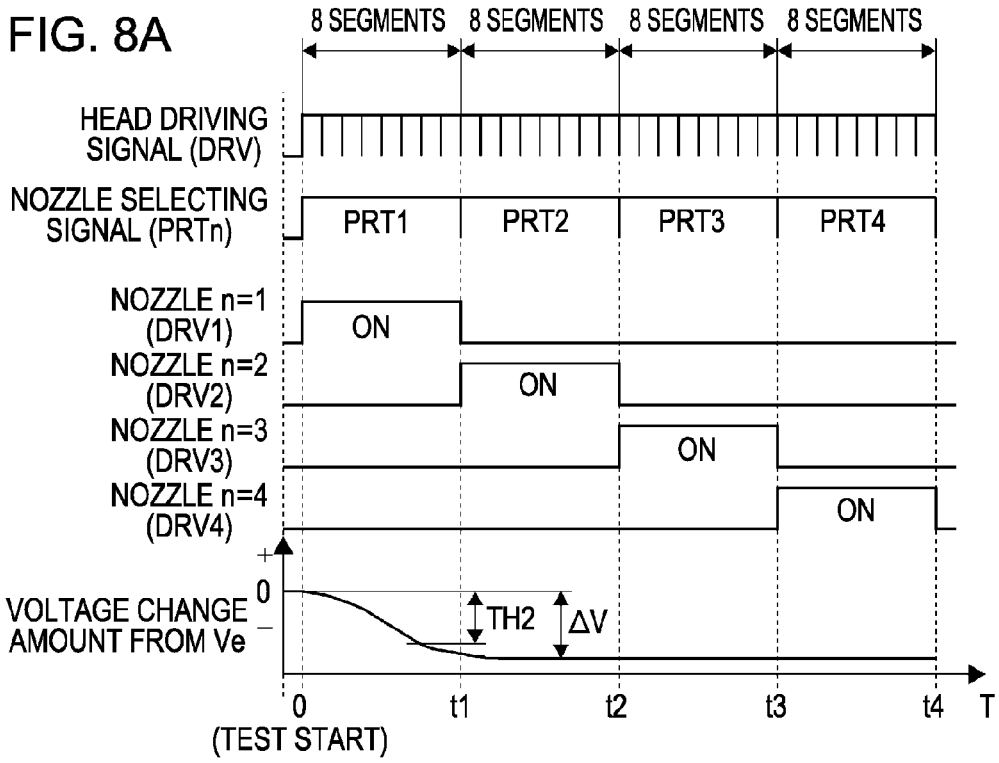
FIG. 8A is a timing chart of signals according to the second embodiment of the invention.

Hereinafter, the process in the second embodiment will be described in more detail with reference to timing charts shown in FIGS. 8A and 8B. FIG. 8A shows a head driving signal in which unit signals that last for one segment are continuously output from start of the test (T=0). In response, a nozzle selecting signal sequentially outputs PRTn with n=1 to n=180, and piezoelectric element drives signals (DRV1 to DRV4) for the nozzles with n=1 to n=4. The horizontal axis denotes a time axis T.

FIG. 8A shows that the voltage Ve between the measurement terminals gradually decreases in accordance with the number of times of ejection and decreases by ΔV, exceeding the threshold value TH2 at a time when nozzle n=1 is selected. In accordance with the nozzle selecting signal PRT1, unit signals are output to nozzle n=1 during 8 segments from the start of the test (T=0) to time t1, and ink droplets are ejected. Here, the threshold value TH2, as described above, is used for determining whether ink droplets are ejected from a nozzle.

Next, right after the selection of nozzle n=1, nozzle n=2 is selected in accordance with the nozzle selecting signal PRT2, whereby the unit signals for 8 segments are output for nozzle n=2 from time t1 to time t2. When the ink droplets are ejected, the voltage Ve between the measurement terminals further decreases in accordance with the number of times of ejection to be constant or maintains at the already reached constant value voltage value decreased by ΔV. Then, right after the selection of nozzle n=2, nozzle n=3 is selected in accordance with the nozzle selecting signal PRT3, whereby the unit signals for 8 segments are output for nozzle n=3 from time t2 to time t3. Then, right after the selection of nozzle n=3, nozzle n=4 is selected in accordance with the nozzle selecting signal PRT4, whereby the unit signals for 8 segments are output for nozzle n=4 from time t3 to time t4. In this way, the piezoelectric element driving signals are continuously output to the sequentially selected nozzles. When ink droplets are ejected from each nozzle, the voltage between the measurement terminals continuously maintains the decreased voltage without change.

Figure 8B:
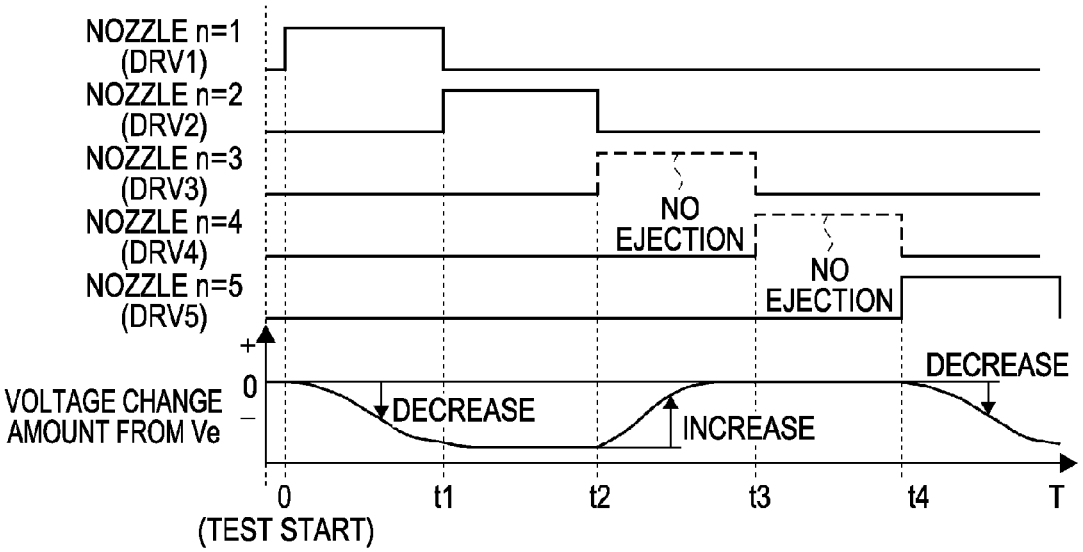
FIG. 8B is a timing chart of signals according to the second embodiment of the invention when there is no ejection of ink drops.

FIG. 8B shows a case where ink droplets are not ejected from nozzle n=3 and nozzle n=4 in FIG. 8A. As shown in the figure, the voltage between the measurement terminals gradually increases from time t2 to time t3 after start of driving nozzle n=3. Since ink droplets are not ejected from time t3 to time t4 during which nozzle n=4 is driven, the voltage continues to gradually increase or returns to its original voltage value Ve to be unchanged thereafter. Then, when ink droplets are ejected from nozzle n=4 after time t4, the voltage between the measurement terminals decreases again.

As described above, when ink droplets are ejected from a nozzle, the voltage between the measurement terminals decreases or continues to be in a decreased status. On the other hand, when ink droplets are not ejected from a nozzle, the voltage between the measurement terminals increases or continues to be in an increased status. Accordingly, it becomes possible to determine whether ink droplets are ejected from a nozzle using the voltage change.

As described above, according to the second embodiment, whether ink droplets are ejected from a nozzle can be determined by allowing continuous ink ejection when a test nozzle is changed by detecting the change of voltage between the measurement terminals. Accordingly, it is possible to shorten the time required for a nozzle test.

In the second embodiment, as shown in FIGS. 8A and 8B, there is no OFF period during which a piezoelectric element driving signal DRVn is not outputted. In other words, there is not a segment during which a driving signal not outputted to a nozzle between a segment (period) when a driving signals are outputted to test nozzles. Thus, a driving signal is outputted to one test nozzle for each segment. As described above, although the state in which a driving signal DRVn is outputted continuously is referred to as a continuous, in this embodiment, the continuous status also includes the case where a unit signal is not outputted for one to two segments while a test nozzle is shifted.

For example, during an OFF period, in which a nozzle selecting signal is not output, one segment after time t1 the voltage changes according to amount shown in the lower side of FIG. 8A. Thus, the amount of change in the voltage increases for the period but decreases immediately due to ink droplets ejected from nozzle 2 at the 2nd segment, whereby returning to the voltage change amount of ΔV. As described above, it is possible to regard the case where a period in which a unit signal is not output for a few segments, which does not have an effect on the determination of ejection due to voltage increase as a continuous state.

Third Embodiment

Hereinafter, the first embodiment will be described in accordance with a flowchart shown in FIG. 9. In the third embodiment, as described above, the nozzle test process described in the second embodiment is performed simultaneously for two color nozzle arrays.

When this process is started, a voltage is applied between the print head 30 and the electrode member 71 (step S301). As in the first embodiment, the ASIC 61 applies the voltage having a direction from the print head 30 side to the electrode member 71 side by driving a voltage generating circuit. Accordingly, the print head 30 side is charged positively, and the voltage between the measurement terminals decreases when charged ink droplets are ejected, as described with reference to FIGS. 4A, 4B, 4C, and 4D. On the other hand, when the charged ink droplets are not ejected, the voltage between the measurement terminals increases. In this process, the CPU 51 stores the direction of the voltage in a predetermined storage area of the RAM 53.

Next, n, which is a test nozzle number, is set to one (step S303), and the nth nozzle of the nozzle array Y (yellow) and the nth nozzle of the nozzle array of M (magenta) are selected (step S304). In other words, at first, nozzles n=1 are selected from the two nozzle arrays of Y and M. In the embodiment, although test nozzles are selected from the two nozzle arrays of Y and M, the test nozzles may be selected from arbitrary two nozzle arrays such as Y and C (cyan) or C and K (black). Thereafter, the test process shown in the flowchart of FIG. 9 is performed for two color nozzle arrays other than the firstly selected two color nozzle arrays, whereby the test process is performed all the color nozzle arrays.

Next, the selected nozzles are driven (step S305). In particular, as descried with reference to FIG. 3, the nozzle selecting signals PRTn and the head driving signals DRV for the nozzle arrays of Y and M are outputted to the mask circuit of the driver substrate 31 from the ASIC 61. Then, the driving signals DRVn are outputted from the mask circuit to the piezoelectric elements and the piezoelectric elements corresponding to the test nozzles are driven, whereby the nozzle driving process is performed.

Next, a change in the value of the voltage between the measurement terminals is detected (step S306) and the change in the amount of the voltage between the start of driving the nth nozzle and the end of driving the nth nozzle is calculated by summing the change values of the voltage that have been detected (step S307). The process for the steps S306 and S307 are the same as the process for the steps S206 and S207 in the second embodiment. Accordingly, description thereof is omitted here.

In the embodiment, as in the second embodiment, in order to reduce incorrect determination due to a noise or the like, it is determined that there is increase or decrease in the voltage for determination of the increase or decrease of the voltage between the measurement terminals in step S310 when the increased or decrease amount that is the change amount of the voltage exceeds the threshold value TH2.

When it is determined that the voltage has decreased (step S310: YES1), the control proceeds to step S311, and it is determined whether the decreased amount is equal to or larger than a predetermined threshold value TH3. When it is determined that the decreased amount is equal to or larger than the predetermined threshold value TH3 (YES), it is determined that ink droplets are ejected from both the nozzles (step S313). On the other hand, when it is determined that the decreased amount is not equal to and larger than the predetermined threshold value TH3 (NO), it is determined that ink droplets are ejected from one (determined number for ((n−1) th nozzle +1) nozzle (step S314). The threshold value TH3 will be described later with reference to FIG. 10 to be described later.

When it is determined that the voltage has increased (step S310: YES2) as the result of the determination, the control proceeds to step S315, and it is determined whether the increased amount is equal to or larger than the predetermined threshold value TH3. When it is determined that the decreased amount is equal to or larger than the predetermined threshold value TH3 (YES), it is determined that no ink droplets are ejected from both the nozzles (step S316). On the other hand, when it is determined that the increased amount is not equal to and larger than the predetermined threshold value TH3 (NO), it is determined that no ink droplets are ejected from one (determined number for (n−1)-th nozzle +1) nozzles (step S317).

On the other hand, when it is determined that there is no voltage change in step S310 (NO), in step S318, the same determination is assigned for the (n−1)th nozzle as was made for the nth nozzle. In the above-described determination process, the determination is performed with reference to the application direction of the voltage.

Since the previous nozzle, that is, a nozzle prior to the 1st nozzle does not exist in the nozzle test for the 1st nozzle in steps S314, S317, and S318, the default determination that ink droplets were not ejected from the (n−1)th nozzle in the steps is made.

Next, the nozzle number and the ejection result are stored (step S320), n is newly set to the value of "n+1" (step S321), and the control proceeds to step S322. In step S322, it is determined whether n is greater than "180. When n is equal to or less than "180", there is a remaining nozzle to be tested, and accordingly, the control proceeds back to step S304 for repeating the above-described process. When the test for all the nozzles is completed (step S322: YES), the process ends.

In the third embodiment, since the determining process in the steps S310 to S318 shown in FIG. 9 are different from the process in the second embodiment, the process will now be described with reference to FIG. 10.

Figure 10:
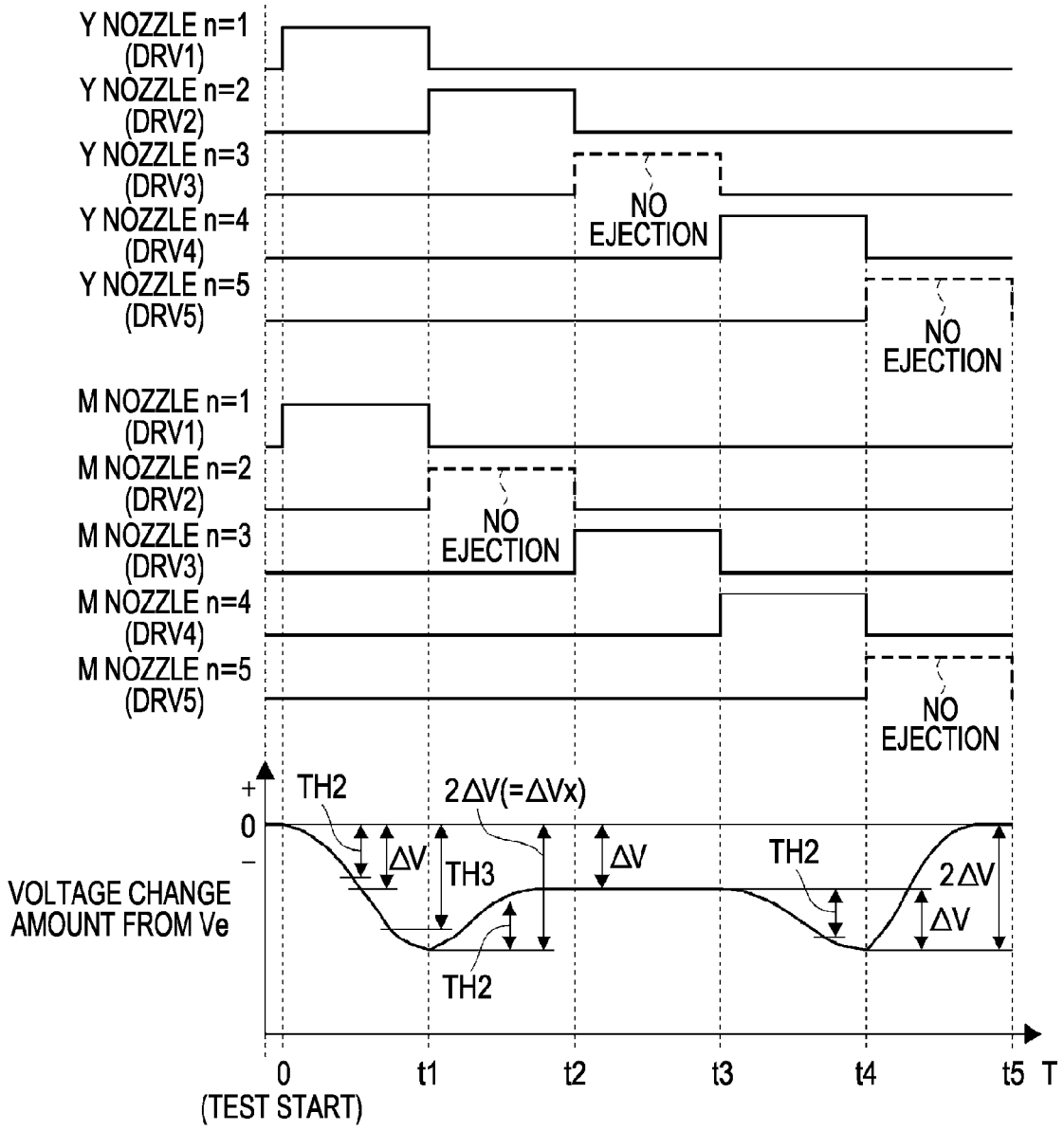
FIG. 10 is a timing chart of signals according to the third embodiment of the invention.

FIG. 10 shows the trend of the voltage between the measurement terminals when the head driving signals DRV are sequentially output to each nozzle n=1 to n=5 of the nozzle arrays of Y and M from start of the test (T=10). The horizontal axis denotes a time axis T.

At first, unit signals are output for 8 segments from the start of the test (T=0) to time t1 to both nozzles n=1. When ink droplets are ejected, the value of the voltage Ve between the measurement terminals, as shown in the figure, gradually decreases in accordance with the number of times of ejection and decreases so as to exceed the threshold value TH2. Since the threshold value TH2, as described above, is used for determining whether ink droplets are ejected from a nozzle, it is determined that the voltage has decreased (step S310: YES1)

Then, the value of the voltage Ve continuously decreases further and comes to decrease by ΔVx that is greater than the voltage change amount ΔV, which occurs at a time when ink droplets are ejected from one nozzle, over the threshold value TH3. As a result, since the amount of voltage decrease between the measurement terminals exceeds the threshold value TH3, it is determined that ink droplets are ejected from both of the nozzles (step S313). When ink droplets are ejected from two nozzles, as described with reference to FIGS. 4A, 4B, 4C, and 4D, positive charges equal to almost twice as many as positive charges lost due to ejection from one nozzle are lost from the print head 30 at one time. Thus the amount of voltage decreases larger than the amount of voltage decrease due to ejection from one nozzle. Thus, it is possible to increase the precision of the determination on whether ink droplets are ejected from a nozzle by setting the threshold value TH3, so as to detect the voltage decrease ΔV in consideration with the voltage variation due to the noise described above. In a description with reference to FIG. 10, since positive charges lost almost twice as many as the positive charges lost from one nozzle, it is assumed that the value of ΔVx is twice the value of ΔV.

Next, the unit signals are output to nozzle n=2 from time t1 to time t2 for 8 segments, immediately after the output of the unit signals to nozzle n=1. When ink droplets are not ejected from nozzle n=2 of the magenta nozzle array M, the voltage between the measurement terminals increases by ΔV, which is the voltage decrease at a time of ink droplet ejection from one nozzle. Thus, since the voltage between the measurement terminals increases by ΔV, the voltage increase between the measurement terminals exceeds the threshold value TH2, and accordingly, it is determined that there is voltage increase (step S310: YES2). However, since the voltage increase does not exceed the threshold value TH3, it is determined that the number of nozzles, from which ink droplets are not ejected is the number of non-ejection nozzles determined in the previous determination for the "(n−1)th nozzle +1" (step S317). In this case, since it has been determined that ink droplets are ejected from two nozzles in the previous determination, it is determined that ink droplets are not ejected from one nozzle.

Next, the unit signals are outputted to nozzle n=3 from time t2 to time t3 for 8 segments, continuously after output of the unit signals to nozzle n=2. At this moment, when ink droplets are not ejected from nozzle n=3 of the yellow nozzle array Y, the voltage between the measurement terminals does not change so as to maintain the value of "Ve−ΔV". Thus, since there is no change in voltage between the measurement terminals, the amount of voltage change does not exceed the threshold value TH2, and accordingly, it is determined that there is no voltage change (step S310: NO). In this case, it is determined that ink droplets are not ejected from one nozzle, which is the same determination as the previous determination (step S318).

Next, the unit signals are outputted to nozzle n=4 from time t3 to time t4 for 8 segments immediately after the output of the unit signals to nozzle n=3. At this moment, when ink droplets are ejected from two nozzles n=3, the voltage between the measurement terminals decrease by 2×ΔV, which occurs at a time when ink droplets are ejected from two nozzles, to be a value of "Ve−2×ΔV". Thus, since the voltage between the measurement terminals decreases by ΔV, the amount of voltage decrease between the measurement terminals exceeds the threshold value TH2, and accordingly, it is determined that there is voltage decrease (step S310: YES1). However, since the voltage increase does not exceed the threshold value TH3, it is determined that the number of nozzles, from which ink droplets are ejected is the number of ejection nozzles determined in the previous determination for the (n−1)th nozzle +1" (step S314). In this case, since it has been determined that ink droplets are ejected from one nozzle in the previous determination, it is determined that ink droplets are ejected from both nozzles.

Next, the unit signals are outputted to nozzle n=5 from time t4 to time t5 for 8 segments immediately after output of the unit signals to nozzle n=4. At this moment, when ink droplets are not ejected from two nozzles n=2, the voltage between the measurement terminals returns to the original voltage value Ve. Thus, since the voltage between the measurement terminals gradually increases by 2×ΔV, the amount of voltage increase exceeds the threshold value TH2, and accordingly, it is determined that there is a voltage increase (step S310: YES2) and the amount of the voltage increase exceeds the threshold value TH3 and accordingly, it is determined that ink droplets were not ejected from both nozzles (step S316).

As described above, in the third embodiment, it is possible to simultaneously perform a nozzle test for two color nozzle arrays by determining whether voltage change of the voltage between the measurement terminals is increased or decreased and comparing the amount of the voltage change with a predetermined threshold value. Thus, the nozzle test may be performed simultaneously for the two color nozzle arrays in addition to eliminating the delay period when ink droplets are not ejected from a nozzle, making it possible to decrease the time required for the nozzle test further.

As described above, when test processes shown in the first, second, and third embodiments are used for an ink jet printer 10 having a nozzle testing apparatus according to an embodiment of the invention, it is possible to perform a nozzle test for a plurality of nozzles with a high precision in a speedy manner by using the direction and amount of voltage change between the measurement terminals due to charged ink droplets.

In the above-described embodiments, in order to adjust the amount of the voltage change between the measurement terminals to a value that can be easily detected at the time when the amount the voltage change is detected, the voltage may be amplified using an amplifier circuit such as an operational amplifier. In such configurations when an inverting amplifier, of which an amplified output signal is inverted with respect to an input signal, is used, the resultant increase/decrease of the detected voltage value becomes opposite the resultant increase/decrease of the detected voltage in the embodiments described above. Thus, when the determination on whether ink droplets are ejected from a nozzle is performed on the basis of the amount of voltage change of the amplified voltage with inversion. Thus, it is determined that there is an ink ejection when the voltage increases, not decreases. In addition, it is preferable that the threshold values are set on the basis of the amplified increased/decreased value.

While three embodiments of the invention have been described, the present invention is not limited to these embodiments and examples at all, and various changes in form and details may be made therein without departing from the scope of the invention.

First Modified Example

In the embodiments described above, although the change value between the voltages before and after nozzle driving is detected in order to determine whether ink droplets were ejected from a nozzle based on the change acquired by summing the difference in the voltage values, the voltage change between the measurement terminals may be acquired as a change rate (change amount per hour) of the voltage, that is, as a wave slope representing voltage change. In this case, the wave slope having a negative value can represent decrease of the voltage, and the wave slope having a positive value can represent increase of the voltage. Thus, since the increase/decrease of the voltage change can be determined on the basis of the sign of the wave slope, the determination process can be easily performed. In addition, in the embodiments described above, the change amount used for determining whether ink droplets were ejected from a nozzle is acquired by detecting the change amount of the voltage from start of the nozzle driving to end of the nozzle driving, so as to be able to detect whether ink droplets are ejected from a nozzle even in the case where the voltage change between the measurement terminals is small. However, one modification may be applied when changes occur in the voltage per hour, so that it may be determined whether ink droplets are ejected from a nozzle. Using this modification, the process for summing change values of the voltage detected in an interval of one segment is not required, whereby it is possible to decrease the processing load.

Figure 11:
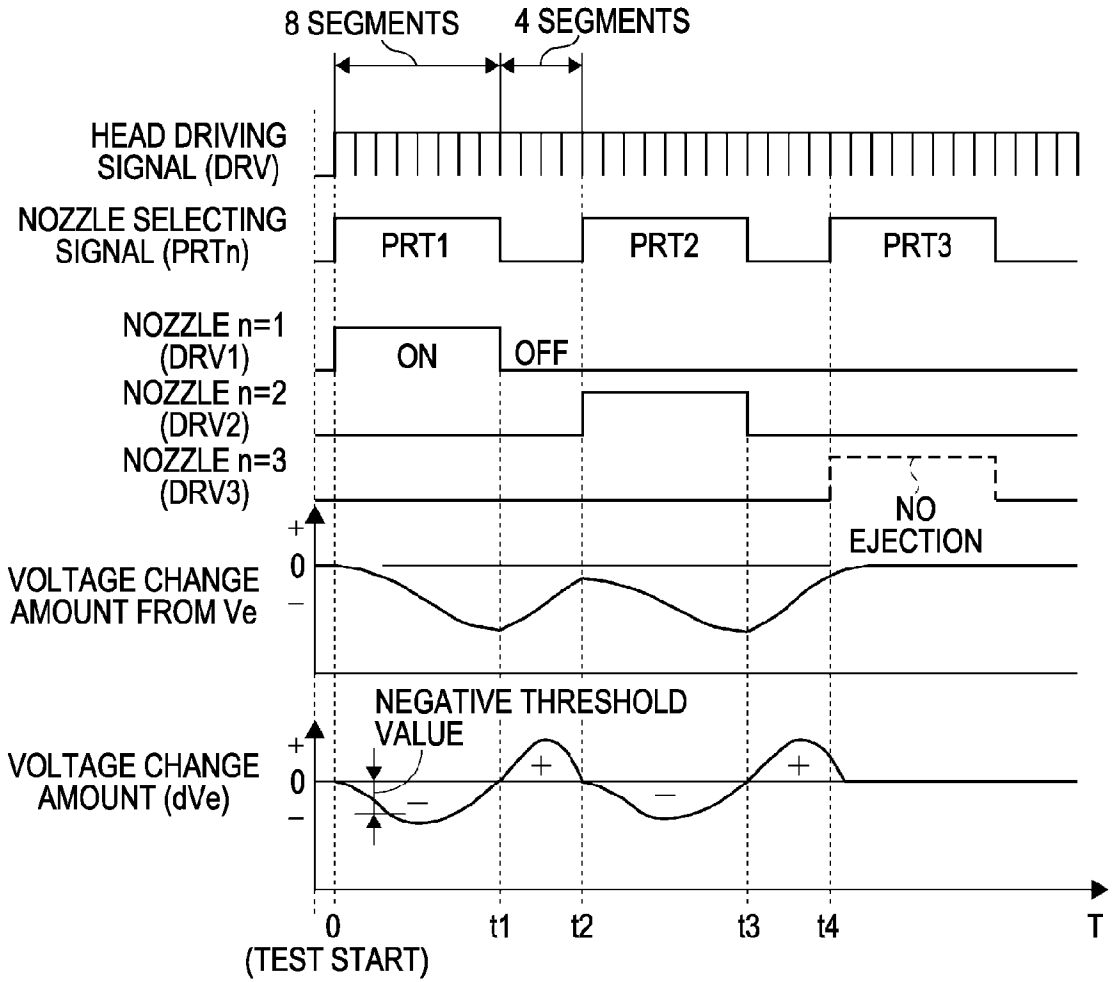
FIG. 11 is a timing chart of signals when a first modified example is applied to the first embodiment.

Hereinafter, the first modified example will be described with reference to FIG. 11. FIG. 11 shows a case where this modified example is applied to the first embodiment. FIG. 11 illustrates a graph for a voltage change rate dVe added to the timing chart shown in FIG. 6B. The scale of the amount of voltage change and the voltage change rate in the vertical axes is different. In this modified example, as previously described, since the changes of the voltage detected at intervals of one segment indicate the voltage change rates, the change values of the voltage detected at intervals of one segment are acquired and may be used for calculating the voltage change rate dVe. The voltage change rates dVe can be acquired by measuring the voltages between the measurement terminals and calculating differences of the measured voltages in each segment, or the voltage change rate dVe can be acquired by differentiating the measured voltage. The voltage change rates dVe may be acquired by the voltage change acquiring unit as voltage changes.

As shown in FIG. 11, when ink droplets are ejected in the ON period (for example, period from t2 to t3) when the head driving signals are output to nozzles n=1, n=2, and n=3, the voltage between the measurement terminals gradually decreases, and accordingly, the voltage change rate dVe becomes a negative value. On the other hand, in the OFF period (for example, a period from t1 to t2) when the head driving signal is not output, since ink droplets are not ejected, the voltage change rate dVe increases (recovers). Accordingly, voltage change rates dVe becomes a positive value. Thus, threshold values are set in the positive and negative sides for the positive and negative values, and it is determined that the voltage change rate dVe has increased at a time when the positive value exceeds the positive threshold value and the voltage change rate dVe is decreased at a time when the negative value exceeds the negative threshold value. As described above, the measured voltage between the measurement terminals may vary in a considerable range due to electric field noise, a pulse signals Pv, or the like from outside of the printer. Accordingly, the threshold values are provided so as to detect the voltage change with a high precision. In this modified example, the voltage change is determined summing the voltage change values. Since decrease of the voltage value may be determined, a negative threshold is required. In the modified example, both a negative and positive threshold values may not be required, and thus, one or two threshold values may be set, and whether ink droplets are ejected is determined on the basis of the set threshold value.

Figure 12:
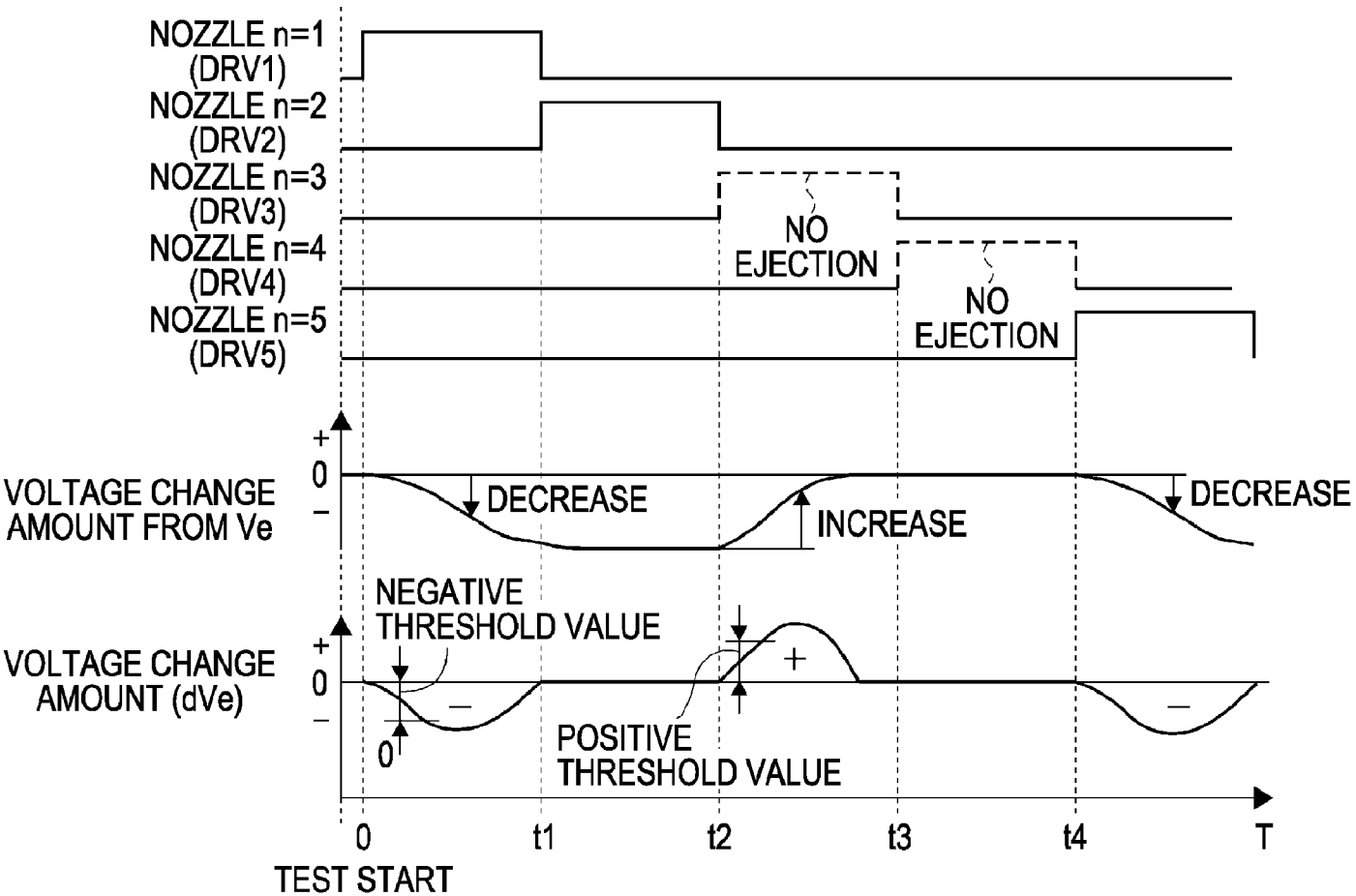
FIG. 12 is a timing chart of signals when a first modified example is applied to the second embodiment.

The modified example applied to the first embodiment will be described with reference to FIG. 12. FIG. 12 shows a graph for a voltage change rate dVe added to the timing chart shown in FIG. 8B. As shown in FIG. 12, since the voltage between the measurement terminals increases when ink droplets are ejected from nozzle n=1 from start of the test (T=0) to time t1, the voltage change rate dVe has negative values forming a shape of a downward-sloping convex curve in a segment when nozzle n=1 is driven. Then, when nozzle n=2 is driven right after the driving of nozzle n=1, if ink droplets are ejected from nozzle n=2, the voltage between the measurement terminals does not change, maintaining the decreased voltage value, and accordingly, the voltage change rate dVe is unchanged to have an almost zero value in the segment when nozzle n=2 is driven. Then, when ink droplets are not ejected from nozzle n=3 that is driven right after the driving of nozzle n=2, the voltage between the measurement terminals changes to increase. When nozzle n=3 is driven, the voltage change rate dVe has positive values to form an upward-sloping convex curve. Then, when nozzle n=4 is driven right after the driving of nozzle n=3, if ink droplets are not ejected from nozzle n=4, meaning that the voltage between the measurement terminals does not change. Accordingly, the voltage change rate dVe is unchanged to have an almost zero value in the segment when nozzle n=4 is driven. Then, when ink droplets are not ejected from nozzle n=3, the voltage between the measurement terminals increases, and accordingly, the voltage change rate dVe has positive values to form an upward-sloping convex curve as shown in the figure. Then, when nozzle n=5 is driven, when ink droplets are ejected from nozzle n=5, the voltage between the measurement terminals decreases again. Accordingly, the voltage change rate dVe has negative values forming a shape of a downward-sloping convex curve, which is the same as the segment when nozzle n=1 was driven.

As the case where the first modified example is applied to the first embodiment, threshold values are set in the positive and negative sides for the positive and negative values, and it is determined that the voltage change rate dVe has increased when the positive value exceeds the set positive threshold value and the voltage change rate dVe is decreased at a time when the negative value exceeds the set negative threshold value. When the voltage change rate dVe does not exceed both the positive and negative threshold values, it is determined that there is no change, that is, the same as the determination on whether ink droplets are ejected from the previous nozzle. In this modified example, in the process of step S310 described with reference to FIG. 9, the voltage change is determined as described above without summing the voltage change values.

Figure 13:
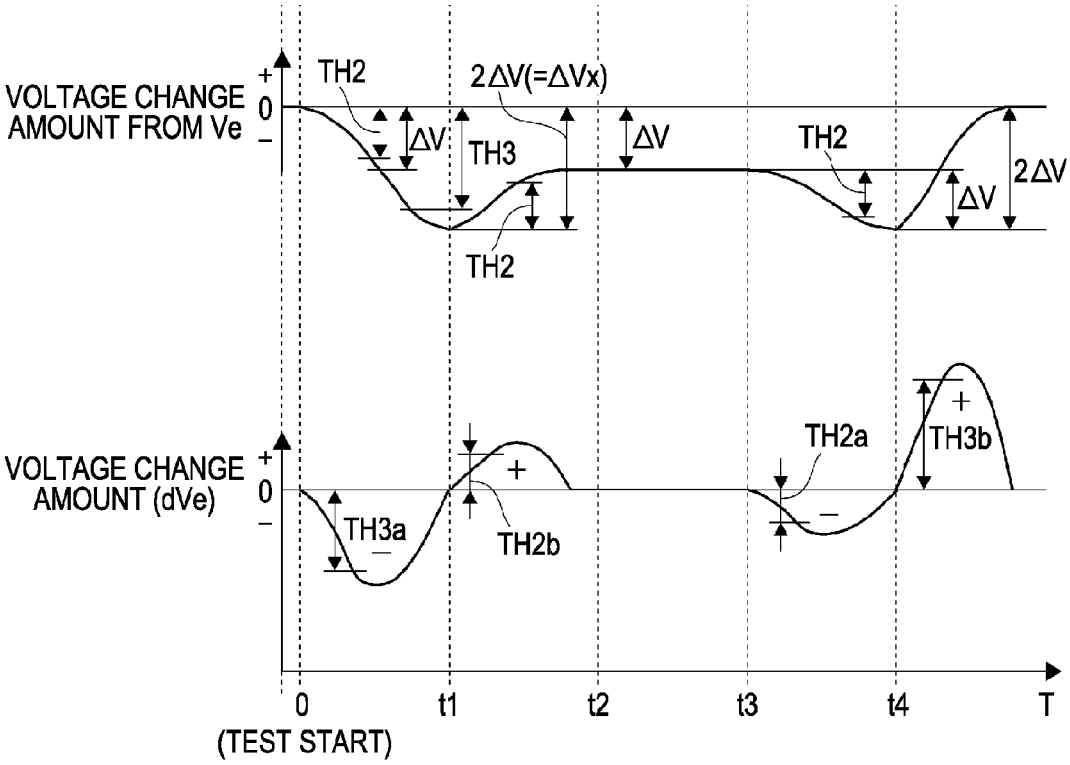
FIG. 13 is a timing chart of signals when a first modified example is applied to the third embodiment.

The modified example can be applied to the third embodiment, as shown in FIG. 13. FIG. 13 shows a graph with the voltage change rate dVe corresponding to the amount of voltage change of the voltage Ve added to FIG. 10. The voltage change rate dVe has a shape from a point starting to slope according to the amount of voltage change. Accordingly, the determination on whether ink droplets are ejected from a nozzle can be made by setting negative threshold values TH3*a* and TH2*a* and positive threshold values TH2*b* and TH3*b* for the voltage change rate, corresponding to the threshold values TH3 and TH2 for the amount of voltage change and by performing determination processes in steps S310, S311, S315 shown in FIG. 9 on the basis of the set threshold values.

In the above described second embodiment, when determination on whether ink droplets are ejected is made by using the amount of voltage change, the amount of voltage change may exceed the threshold value TH2, such as in the 6th to 7th segment after the start of the driving signal. For example, in FIGS. 8A and 8B, the amount of voltage change may exceed the threshold value TH2 after 6 to 7 segments after the start of driving signal for nozzle n=1. In the embodiment described above, when the voltage change fluctuates due to the noise, the amount of the voltage change may not exceed the threshold value TH2 during 8 segments that is a driving period of nozzle n=1, but may exceed the threshold value TH2 after the next test nozzle n=2 is driven. In this case, although ink droplets are ejected from the test nozzle n=1, since the amount of voltage change does not exceed the threshold value TH2 during the driving period of nozzle n=1 due to the noise, it is determined that ink droplets were not ejected from the test nozzle n=1. However, when the voltage change rate according to the modified example is used, as shown in FIG. 12, there is a high probability that the maximum value of the voltage change rate will be located in the approximate center position in the nozzle driving period. Accordingly, the voltage change rate will be within the driving period of correct the test nozzle. As a result, it is possible to shorten the test time while reducing the probability of having an incorrect determination, making it possible to determine whether ink droplets are ejected with high precision. Additionally, the process for summing the voltage change values is not required, and the processing load is reduced.

Here, in the first embodiment, although the determination on whether ink droplets are ejected from a nozzle is made based on the voltage change rate, in a modified example of the first modified example, the start of the output of a driving signal for the next test nozzle may be determined based on whether the voltage change rate is within a threshold value.

For example, in the first embodiment, when the amount of the voltage change is within the threshold value TH1, the next nozzle is tested in steps S105 to S107 (FIG. 5). In the modified example, as shown in FIG. 11, once the voltage between the measurement terminals at time t2 reaches the threshold value TH1 with respect to the original voltage value Ve, the voltage change rates dVe is changed from a point having almost "0" value, and the next nozzle may be tested. Accordingly, the process of summing the voltage change values detected at intervals of one segment is not required, reducing the processing load.

In the second embodiment, the nozzles are driven continuously by changing the test nozzle at intervals of 8 segments. However, as shown in FIG. 12, when the amount of voltage change becomes approximately constant due to continuous ejection of ink drops, the next test nozzle may be driven immediately from the point when the voltage change rate dVe reaches approximately "0" at when the voltage change rate is within a threshold value. In this case, the number of segment for driving a test nozzle can be set to the number for which the maximum amount of the voltage change between the measurement terminals can be acquired. As a result, since the amount of voltage change appropriate for the determination in the test can be acquired, the precision of the nozzle ejection test can be improved. In the first modified example described above, as above-described examples, the output signal may be amplified by using an operational amplifier.

Second Modified Example

In the embodiments described above, although a nozzle test voltage is applied between the print head 30 and the electrode member 71 such that the print head 30 side has a positive electric potential, the nozzle test voltage may be applied such that the electrode member 71 side has a positive electric potential. In this case, when a high voltage cannot be applied to the print head 30 side, as in an ink jet printer having a structure in which a high voltage generating circuit cannot easily be built around the print head 30 or the like, the nozzle test voltage can be applied between the measurement terminals.

Figure 14:
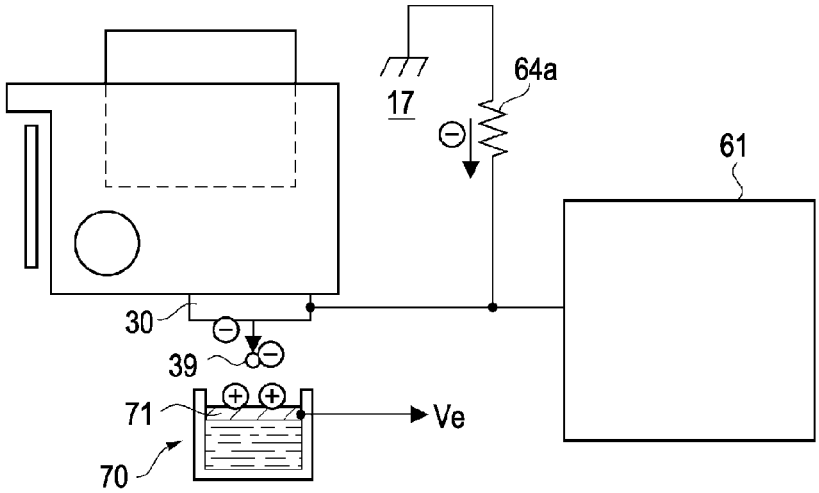
FIG. 14 is a schematic diagram showing an example when a voltage having a different direction is applied to a second modified example according to an embodiment of the invention.

FIG. 14 shows an example of application of a voltage according to the modified example. As shown in the figure, the print head 30 side is grounded to a frame 17 through a resistor, and a voltage Ve having electric potential higher than the frame 17 is applied to the electrode member 71 of the test box 70. Accordingly, in the modified example, a voltage having the application direction from the electrode member 71 side to the print head 30 side 30 is applied.

In this case, the print head side 30, as shown in the figure, is negatively charged, and accordingly, a negative charge is lost in accordance with ejection of an ink droplet 39. When the negative charge is lost, a negative charge moves from the frame 17 through a resistor 64*a* for supplementing the lost negative charge. This corresponds to a flow of a current from the print head 30 side to the frame 17 through the resistor 64*a*. In other words, the voltage value of the print head increases. Thus, in the modified example, since the application direction of the voltage is opposite that in the above-described embodiments, the determination on whether ink droplets are ejected from a nozzle is opposite the determination in the above-described embodiments. In other words, when the voltage value between the measurement terminals increases, it is determined that ink droplets were ejected, and when the voltage value between the measurement terminals decreases, it is determined that ink droplets were not ejected.

For example, in the second embodiment shown in FIG. 7, when it is determined that the voltage decreases in step S210 (YES1), it is determined that ink droplets were ejected from the nth nozzle in step S211, and when it is determined that the voltage increases (YES2) it is determined that ink droplets were not ejected from the nth nozzle in step S212. In contrast, when it is determined that the voltage increases, it is determined that ink droplets were ejected from the nth nozzle in step S211, and when it is determined that the voltage decreases, it is determined that ink droplets were not ejected from the nth nozzle in step S212. In addition, when there is no change in the voltage value (NO), as in the second embodiment, the same determination as was made for the (n−1)th nozzle is made for the nth nozzle in step S213.

As described above, when the change value of the voltage between the measurement terminals is amplified by using an inverting amplifier, an output signal of which is inverted, the increase/decrease of the detected voltage value is opposite. Accordingly, when an inverted amplification is used, the determination on whether ink droplets are ejected is the same as that in the second embodiment, instead the modification described above.

Third Modified Example

In the third embodiment, although test nozzles are sequentially selected, simultaneously from two color nozzle arrays, the test nozzles may be sequentially selected, simultaneously from three color nozzle arrays. Furthermore, the test nozzles may be sequentially selected, simultaneously from four color nozzle arrays. In this case, by performing a nozzle test process for testing whether ink droplets are ejected at one time, it is possible to determine the number of nozzles that are ejecting or the number of nozzles that are not ejecting. Thus, in a test for detecting the number of nozzles that are not ejecting, in which a nozzle color and a nozzle number need not be specific, as in the modified example, the nozzle test process may be performed for a plurality of color nozzle arrays at one time, making it possible to decrease the time required for a test considerably.

As described above, when a plurality of color nozzle arrays are simultaneously tested, it is preferable that a number of threshold values corresponding to the number of test color nozzle arrays are provided in order to determine the number of nozzles successfully ejecting ink droplets or the number of nozzles that are not successfully ejecting ink droplet.

Fourth Modified Example

When the time required for voltage recovery is known, the head driving signal may be configured not to be output for the number of segments corresponding to the known recovery time. In this case, after the head driving signal is output to one nozzle, the process (FIG. 5: steps S105 to S107) of comparing the amount of change in the voltage between the measurement terminals with a critical value from start of the nozzle test may not be performed, reducing the processing load.

In this case, the nozzle selecting signal may be generated to have an OFF period that is longer than the voltage recovery time between the measurement terminals with a minimal number of segments and outputted to the mask circuit. In this case, the time required to change the test nozzles can have the minimal number of segments.

Other Modified Example

In the above described embodiments, although a nozzle selecting signal is generated so as to output a unit signal continued for 8 segments for each nozzle, the present invention is not limited thereto, and the number of the segments for the unit signal may be increased or decreased, for example to 4 segments or 16 segments. As shown in FIGS. 4A, 4B, 4C, and 4D, the status of the voltage change between the measurement terminals may vary depending on the conditions of ink droplet ejection such as the quantity of electric charge accompanied by one ink droplet or the number of ejection per one segment. Thus, it is preferable that a conditions for easily detecting the voltage and is checked in advance such that the number of the segments for the unit signal may be determined in accordance with the conditions. In this case, the voltage change between the measurement terminals can be easily detected, improving the precision of the nozzle test.

In the above-described embodiments, although the voltage change between the measurement terminals is detected at intervals of one segment, the duration of the segment and the interval of detection may be configured to be different from each other. For example, the voltage change may be detected two or more times in one segment. In this case, for example, since the voltage change rates can be acquired at intervals of a time shorter than one segment in the above-described first modified example, whereby the voltage change rate can be detected at a higher precision. As a result, the precision of determination on whether ink droplets are ejected can be improved.

Furthermore, in the above-described embodiments, although the ink droplets are ejected from a nozzle by driving a piezoelectric element, however, a configuration may be used in which ink is heated by applying a voltage to a heat element (for example, a heater or the like) and ink droplets are ejected by pressing the ink using air bubbles. In this case, a nozzle testing apparatus according to an embodiment of the invention may be used for an ink jet printer that does not use a piezoelectric element.

Furthermore, in the above-described embodiments, as shown in FIG. 1, although a test box 70 is provided and the electrode member 71 inside the test box is used as one of the measurement terminals, there may be used a configuration in which a cleaning box 18 used for cleaning nozzles an electrode member is formed inside the cleaning box as the measurement terminal. In this case, a nozzle can be tested without having additional test box. In addition, when a cleaning process is performed after the nozzle test, a carriage is not required to move from the test box to the cleaning box, whereby the time required for starting the cleaning process can be shortened.

What is claimed is:

1. A nozzle testing apparatus that tests whether a recording liquid has been ejected from a plurality of nozzles, the nozzle testing apparatus comprising:

a print head provided with the plurality nozzles;

a voltage applying unit applying a voltage between at least two measurement terminals in a predetermined direction;

a head driving unit capable of ejecting the recording liquid from the plurality of nozzles;

a voltage change acquiring unit capable of acquiring a change of the voltage between the measurement terminals, the change of voltage being generated in accordance with an ejection of the recording liquid; and an ejection checking unit capable of individually determining whether the recording liquid has been ejected from the plurality of nozzles using the change of the voltage; and a nozzle selecting unit capable of selecting a first nozzle and a second nozzle to be tested from the plurality of nozzles, wherein one of the at least two measurement terminals is disposed in the print head and wherein another of the at least two measurement terminals is disposed on an ejection target wherein the head driving unit drives the print head for ejecting the recording liquid from the second nozzle after a predetermined interval from when the head driving unit drives print head for ejecting the recording liquid from the first nozzle, wherein the predetermined interval is longer than a time to determine whether the recording liquid has been ejected from the first nozzle using the change of voltage generated in accordance with the ejection of the recording liquid from the first nozzle, wherein the predetermined interval is shorter than a time during which the change of voltage generated in accordance with the ejection of the recording liquid from the first nozzle continues.

2. The nozzle testing apparatus according to claim 1, wherein the voltage change acquiring unit acquires the change of the voltages based on changed voltage rates.

3. The nozzle testing apparatus according to claim 2, wherein the ejection checking unit sets a negative threshold or a positive threshold for the changed voltage rates of the voltage acquired by the voltage change acquiring unit and determines whether the recording liquid is ejected from the nozzles based on whether the acquired changed voltage rates exceed the set threshold.

4. The nozzle testing apparatus according to claim 1, wherein the ejection checking unit sets a negative threshold or a positive threshold for determining the changes of the voltage acquired by the voltage change acquiring unit and determines whether the recording liquid is ejected from the nozzles based on whether the acquired change of the voltage exceeds the set threshold.

5. The nozzle testing apparatus according to claim 1, wherein the head driving unit drives the print head for ejecting the charged recording liquid from the first nozzle and second nozzle which have been selected to be tested, and wherein the head driving unit continuously outputs a head driving signal to the print head for a predetermined period in order to cause the recording liquid to be ejected from the first nozzle and second nozzle which have been selected to be tested.

6. The nozzle testing apparatus according to claim 1, further comprising:

wherein the head driving unit causes the print head to generate pressure on the recording liquid in order to eject the charged recording liquid from the first nozzle and second nozzle which have been selected, and wherein after testing the first nozzle selected to be tested, the head driving unit does not drive the print head for the second nozzle selected to be tested until the voltage between the measurement terminals acquired by the voltage change acquiring unit is within a predetermined threshold value.

7. The nozzle testing apparatus according to claim 1, further comprising:

wherein the ejection checking unit determines the number of nozzles that have ejected the recording liquid by using a predetermined threshold when a plurality of nozzles are selected by the nozzle selecting unit to be tested.

8. The nozzle testing apparatus according to claim 1, wherein the measurement terminals detect a change in voltage between the print head and a recording liquid receiving area which receives the ejected recording liquid.

9. A method of testing whether a recording liquid is ejected from a plurality of nozzles provided in a print head, the method comprising:

applying a voltage between at least two measurement terminals in a predetermined direction;

ejecting the recording liquid from the nozzles;

acquiring a change of the voltage between the measurement terminals, the change of voltage generated in response to the ejection of the recording liquid; and determining whether the recording liquid is ejected from the plurality of nozzles by using the change of the voltages; and selecting a first nozzle and a second nozzle to be tested from the plurality of nozzles, wherein one of the at least two measurement terminals is disposed in the print head and wherein another of the at least two measurement terminals is disposed on an ejection target, wherein a head driving unit drives the print head for ejecting the recording liquid from the second nozzle after a predetermined interval from when the head driving unit drives print head for ejecting the recording liquid from the first nozzle, wherein the predetermined interval is longer than a time to determine whether the recording liquid has been ejected from the first nozzle using the change of voltage generated in accordance with the ejection of the recording liquid from the first nozzle, and wherein the predetermined interval is shorter than a time during which the change of voltage generated in accordance with the ejection of the recording liquid from the first nozzle continues.

10. A nozzle testing apparatus that tests whether a recording liquid has been ejected from a plurality of nozzle, the nozzle testing apparatus comprising:

a print head provided with the plurality nozzles;

a nozzle selecting unit capable of sequentially selecting a first nozzle and a second nozzle to be tested from the plurality of nozzles, a voltage applying unit capable of applying a voltage between at least two measurement terminals in a predetermined direction;

a head driving unit capable of ejecting the recording liquid from the plurality of nozzles;

a voltage change acquiring unit capable of acquiring a change of the voltage between the measurement terminals, the change of the voltage being generated in accordance with an ejection of the recording liquid; and an ejection checking unit capable of individually determining whether the recording liquid has been ejected from the plurality of nozzles using the change of the voltage;

wherein the head driving unit continuously outputs a head driving signal to the print head for a predetermined period in order to cause the recording liquid to be ejected from the first nozzle and second nozzle which have been selected to be tested;

wherein after testing the first nozzle selected to be tested, the head driving unit does not drive the print head for the second nozzle selected to be tested until the voltage between the measurement terminals acquired by the voltage change acquiring unit is within a predetermined threshold value, wherein a predetermined interval is longer than a time to determine whether the recording liquid has been ejected from the first nozzle using the change of voltage generated in accordance with the ejection of the recording liquid from the first nozzle, wherein the predetermined interval is shorter than a time during which the change of voltage generated in accordance with the ejection of the recording liquid from the first nozzle continues, wherein one of the at least two measurement terminals is disposed in the print head and wherein another of the at least two measurement terminals is disposed on an ejection target.

11. The nozzle testing apparatus according to claim 10, wherein the voltage change acquiring unit acquires the changes of the voltages based on the changed voltage rates.

12. The nozzle testing apparatus according to claim 11, wherein the ejection checking unit sets a negative threshold or a positive threshold for the change rates of the voltage acquired by the voltage change acquiring unit and determines whether the recording liquid is ejected from the nozzles based on whether the acquired change rates of the voltages exceed the set threshold.

13. The nozzle testing apparatus according to claim 10, wherein the ejection checking unit sets a negative threshold or a positive threshold for determining the changes of the voltage acquired by the voltage change acquiring unit and determines whether the recording liquid is ejected from the nozzles based on whether the acquired changes of the voltages exceed the set threshold.

* * * * *